US005467176A

United States Patent [19]

Watanuki et al.

[11] Patent Number: 5,467,176

[45] Date of Patent: Nov. 14, 1995

[54] IMAGE FORMING METHOD AND APPARATUS WITH MAGNETIC BRUSH

[75] Inventors: Tsuneo Watanuki; Yasushige Nakamura; Satoshi Takezawa; Norio Sawatari; Akira Nagahara; Sachio Sasaki; Mitsuru Sato; Shigenobu Utaka, all of Kawasaki; Takefumi Takahashi, Inagi; Masahiro Wanou; Masao Konishi, both of Kawasaki, all of Japan

[73] Assignee: Fujitsu Limited, Kawasaki, Japan

[21] Appl. No.: 220,601

[22] Filed: Mar. 30, 1994

[30] Foreign Application Priority Data

Jun. 24, 1993 [JP] Japan ..... 5-177236

[51] Int. Cl.[6] ..... G03G 15/06; G03G 21/00

[52] U.S. Cl. ..... 355/270; 118/652; 355/251; 430/122; 430/125

[58] Field of Search ..... 355/245, 251, 355/253, 269, 270; 118/652, 653, 657, 658; 430/105, 106.6, 122, 125

[56] References Cited

U.S. PATENT DOCUMENTS

| | | | |
|---|---|---|---|
| 4,142,165 | 2/1979 | Miyakawa et al. | 118/652 X |
| 4,320,958 | 3/1982 | Fantuzzo | 118/652 X |
| 4,350,750 | 9/1982 | Suzuki et al. | 355/270 X |
| 4,800,147 | 1/1989 | Savage | 118/652 X |
| 5,023,666 | 6/1991 | Shimzaki et al. | 355/269 |
| 5,066,982 | 11/1991 | Hosoya et al. | 355/269 |
| 5,066,989 | 11/1991 | Yamamoto | 355/270 |
| 5,075,729 | 12/1991 | Hayashi et al. | 355/269 |
| 5,119,138 | 6/1992 | Oda et al. | 355/269 |
| 5,187,525 | 2/1993 | Fushimi et al. | 355/269 |
| 5,229,825 | 7/1993 | Yousey et al. | 355/270 |

FOREIGN PATENT DOCUMENTS

| | | | |
|---|---|---|---|
| 0354310 | 2/1990 | European Pat. Off. | 355/269 |
| 59-188656 | 10/1959 | Japan . | |
| 60-151685 | 8/1985 | Japan . | |
| 3-185463 | 8/1991 | Japan . | |
| 4-204856 | 7/1992 | Japan . | |

*Primary Examiner*—William J. Royer

*Attorney, Agent, or Firm*—Armstrong, Westerman, Hattori, McLeland & Naughton

[57] ABSTRACT

An electrostatic latent image is developed on a latent image carrier and residual toners are collected at the same time. An electrostatic latent image is formed on a rotary endless latent image carrier; developer, including magnetic toners and magnetic carriers, is supplied to a developing area for developing the latent image carrier, and a magnetic brush is formed with the developer in the developing area to thereby collect residual toners on the latent image carrier and develop the electrostatic latent image on the latent image carrier; and the developed image on the latent image carrier is transferred to a sheet. An electrostatic latent image may be developed with a rotary endless latent image carrier; an image forming unit for forming an electrostatic latent image on the latent image carrier; a developing unit having a developer, including magnetic toners and magnetic carriers, and a developer supplying unit for supplying the developer to a developing area for developing the latent image carrier and forming a magnetic brush with the developer in the developing area in order to develop the electrostatic latent image on the latent image carrier with a powdery developer and collect residual toners on the latent image carrier; and a transfer unit for transferring the developed image on the latent image carrier to a sheet.

53 Claims, 24 Drawing Sheets

| TONER | PARTICLE SIZE (μm) | Fs VALUE | DEVELOPING VIAS (V) | IMAGE DENSITY (O.D.) | BACKGROUND NOISE | TRANSFER EFFICIENCY (%) |
|---|---|---|---|---|---|---|
| EXAMPLE 1 | 9.9 | 0.32 | -500 | 1.49 | ○ | 95.8 |
| EXAMPLE 2 | 10.3 | 0.43 | -500 | 1.47 | ○ | 99.1 |
| EXAMPLE 3 | 9.7 | 0.64 | -550 | 1.50 | ○ | 98.7 |
| EXAMPLE 4 | 9.7 | 0.81 | -600 | 1.48 | ○ | 98.2 |
| EXAMPLE 5 | 5.3 | 0.45 | -400 | 1.46 | ○ | 94.5 |
| EXAMPLE 6 | 5.9 | 0.53 | -450 | 1.48 | ○ | 95.6 |
| EXAMPLE 7 | 7.6 | 0.37 | -400 | 1.48 | ○ | 98.5 |
| EXAMPLE 8 | 7.5 | 0.76 | -500 | 1.44 | ○ | 98.7 |
| EXAMPLE 9 | 11.8 | 0.52 | -550 | 1.50 | ○ | 99.1 |
| COMPARATIVE SAMPLE 1 | 7.3 | 0.23 | — | — | — | — |
| COMPARATIVE SAMPLE 2 | 10.5 | 0.6 | -550 | 1.43 | × | 87.5 |

FIG.26

IMAGE FORMING METHOD AND APPARATUS WITH MAGNETIC BRUSH

BACKGROUND OF THE INVENTION

1. Field of the Invention

The present invention relates to an image forming apparatus which collects residual toners on a latent image carrier by a developing unit.

2. Description of the Related Art

In image recording apparatuses, such as a copying machine, a printer and a facsimile, a latent image forming apparatus like an electrophotographic apparatus is used due to the popularity of image recording on normal sheets of paper. Such an image forming apparatus forms an electrostatic latent image on a photosensitive drum or the like. Then, the electrostatic latent image on the photosensitive drum is developed with a powder developer to provide a visible image. The developed image on the photosensitive drum is then transferred on a sheet, and the sheet is then separated from the photosensitive drum. Thereafter, the developed image on the sheet is fixed.

Due to the recent demand for compact image forming apparatuses and economical usage of resources, it is desirable to employ a method that does not dispose of residual toners on a photosensitive drum.

FIGS. 27A and 27B are explanatory diagrams of prior arts, and FIG. 28 is an explanatory diagram of a cleanerless process.

The conventional image forming apparatuses will be described below as latent image forming apparatuses with reference to a typical electrophotographic printer. As shown in FIG. 27A, various types of process units are disposed around a photosensitive drum 1, such as an organic photosensitive body, Se photosensitive body or a-Si photosensitive body. More specifically, arranged around the photosensitive drum 1 are a precharger 2, an image exposing unit 3, a developing unit 4, a transfer unit 5, a cleaner 6 and a de-electrifying lamp 7.

In the image forming operation, the photosensitive drum 1 is charged by precharger 2, and is exposed by the exposing unit 3 so that an electrostatic latent image is formed on the drum 1 according to the exposed image. The developing unit 4 supplies a powdery developer (e.g., one-component magnetic toners or a two-component developer) to the photosensitive drum 1 to develop the electrostatic latent image. The transfer unit 5 transfers the developed image on the photosensitive drum 1 onto a sheet P that is fed in the arrowhead direction. The sheet carrying the transferred image is then fed to a fixing unit 8 where the developed image is fixed on the sheet.

The efficiency of transferring the toner image on a sheet of paper is not 100%, and some toners will remain on the photosensitive drum. Therefore, the top surface of the photosensitive drum 1 after the toner image transfer on the sheet is cleaned with the cleaner 6 to remove the residual toners. Then, the de-electrifying lamp 7 is activated to remove the residual charges on the photosensitive drum 1 to return the drum 1 to the initialized state to be ready for another printing operation.

The residual toners collected from the photosensitive drum 1 by the cleaner 6 are temporarily stored in a waste-toner tank by a toner carrying mechanism (not shown), and a user will dispose of this tank when a predetermined amount of waste toners is stored.

This image forming process requires a toner disposal mechanism and space for storing the waste toners, and stands in the way of making the image forming apparatus compact. As the toners collected by the cleaner 6 do not contribute to printing, this process is not economical. Further, the disposal of the toners will raise an environmental problem.

In view of the above and due to the recent demands for smaller apparatuses and lower cost, it is desirable to eliminate part of the recording process. As one solution, a cleanerless process to eliminate the need for the cleaner has been proposed as in, for example, "Cleanerless Laser Printer," Electrophotographic Institute Report, vol. 30, no. 3, pp. 293–301.

This cleanerless process eliminates the use of the cleaner 6, and allows the residual toners after image transfer to be collected by the developing unit 4 so that the residual toners can be used again for printing. As shown in FIG. 27B, the cleaner 6 is eliminated and a conductive uniform distribution brush 9 is provided instead in the cleanerless process.

In this recording process, the residual toners on the photosensitive drum 1 are distributed by the distribution brush 9. Then, the surface of the photosensitive drum 1 with toners thereon is uniformly charged by the corona charger 2, an image exposure is performed by the exposing unit 3, and the collection of the residual toners after image transfer and the developing of the electrostatic latent image are carried out at the same time by the developing unit 4.

The toners concentrating locally on the photosensitive drum 1 are distributed by the distribution brush 9 to reduce the amount of toners per unit area, thereby facilitating the toner collection by the developing unit 4. Further, as the toners are distributed, the residual toners are prevented from becoming a filter for ion shower from the corona charger 2 to thereby avoid non-uniform charging. Also, the toners in the exposing step are prevented from becoming a filter to thereby avoid uneven exposure.

The point of this recording process is the collection of the residual toners on the photosensitive drum 1 performed at the same time as the developing step. This point will be described with reference to FIG. 28 which shows the photosensitive drum 1 charged negatively with toners also charged negatively. The surface potential of the photosensitive drum 1 is set to −500 to −1000 V by the charger 2, and the potential of the exposed portion where the potential drop has occurred due to the image exposure is dropped down to 0 to minus several tens of volts, thereby forming an electrostatic latent image. At the developing time, a developing bias voltage (e.g., −300 V) lying nearly in the middle of the surface potential and the latent image potential is applied to the developing rollers of the developing unit 4.

In the developing step, the negatively-charged toners on the developing roller stick on the electrostatic latent image on the photosensitive drum 1 by an electric field formed by the developing bias potential and latent image potential, thereby providing a toner image.

In the cleanerless process, at the same time as the developing step is performed, the residual toners after image transfer, distributed over the photosensitive drum 1 by the distribution brush 9 in the uniform distribution process, are collected to the developing roller from the surface of the drum 1 by the electric field that is created by the surface potential and the developing bias potential.

In the above cleanerless process, (1) no mechanism for disposing toners is required, thus contributing to making the printer compact, (2) no space required to store the disposed toners, (3) all the toners will be used in printing, which is economical, (4) no toners will be disposed of, which is friendly to the environmental preservation, (5) no cleaner, which scrapes the surface of the photosensitive drum 20 to shorten the service life thereof, is used to thereby elongate the life of the drum 20.

According to the prior arts, it has been proposed to employ a one-component non-magnetic developing scheme and a two-component developing scheme which uses non-magnetic toners and magnetic carriers, in this cleanerless process.

According to the conventional one-component non-magnetic developing scheme, the collecting power in the developing process is the electrostatic force which is created by the charged potential of the non-magnetic toners and the developing bias potential. This collecting power is therefore weak and the amount of uncollected toners increases, so that an afterimage is formed.

According to the conventional two-component developing scheme which uses non-magnetic, the collecting power in the developing process is the electrostatic force plus the scraping force by the magnetic brush. Likewise, this collecting power is weak and the amount of uncollected toners increases, so that an afterimage is formed.

In either developing method, toners charged to the opposite potential and low-charged toners, which are apt to stick on the photosensitive drum, and those types of toners cannot be collected by the electrostatic force alone.

SUMMARY OF THE INVENTION

It is therefore a primary object of the present invention to provide an image forming method and apparatus which will improve the toner collecting power of a developing unit in a cleanerless process.

It is another object of the present invention to provide an image forming method and apparatus which will increase the toner collecting power in a developing process to reduce the amount of uncollected toners.

To achieve the foregoing and other objects in accordance with the purpose of the present invention, according to one aspect of the invention, an image forming method comprises the steps of forming an electrostatic latent image on a rotary endless latent image carrier; supplying a developer, consisting of magnetic toners and magnetic carriers, to a developing area for developing the latent image carrier, and forming a magnetic brush with the developer in the developing area to thereby collect residual toners on the latent image carrier and develop the electrostatic latent image on the latent image carrier both by the magnetic brush; and transferring the developed image on the latent image carrier to a sheet.

According to another aspect of the present invention, an image forming apparatus comprises a rotary endless latent image carrier; an image forming unit for forming an electrostatic latent image on the latent image carrier; a developing unit having a developer, consisting of magnetic toners and magnetic carriers, and a developer supplying unit for supplying the developer to a developing area for developing the latent image carrier and forming a magnetic brush with the developer in the developing area in order to develop the electrostatic latent image on the latent image carrier with a powdery developer and collect residual toners on the latent image carrier; and a transfer unit for transferring the developed image on the latent image carrier to a sheet.

According to the present invention, a so-called 1.5-component developing method, which forms a magnetic brush with a developer consisting of magnetic toners and magnetic carriers and supplies the magnetic brush to the latent image carrier, is employed in the developing step for collecting residual toners in the cleanerless process.

With this structure, the scraping force of the magnetic brush sweeps or rolls the residual toners to reduce their contact force to the latent image carrier and the electrostatic force of the magnetic brush attracts the residual toners. Therefore, the residual toners can be collected by the magnetic attraction between the magnetic residual toners and the magnetic brush. This scheme increases the toner collecting power so that most of the residual toners can be collected.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiments given below, serve to explain the principles of the invention.

FIG. 26 is a diagram showing the toner transfer characteristic of individual Examples;

DETAILED DESCRIPTION OF THE PREFERRED EMBODIMENT

Figure 1A:
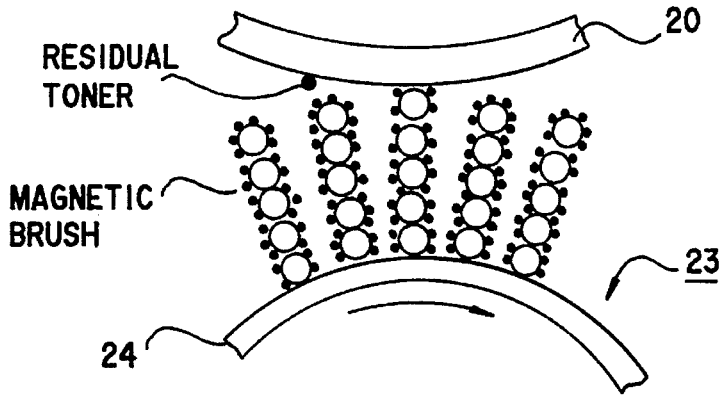
FIGS. 1A, 1B and 1C are diagrams for explaining the principle of the present invention.
Figure 1B:
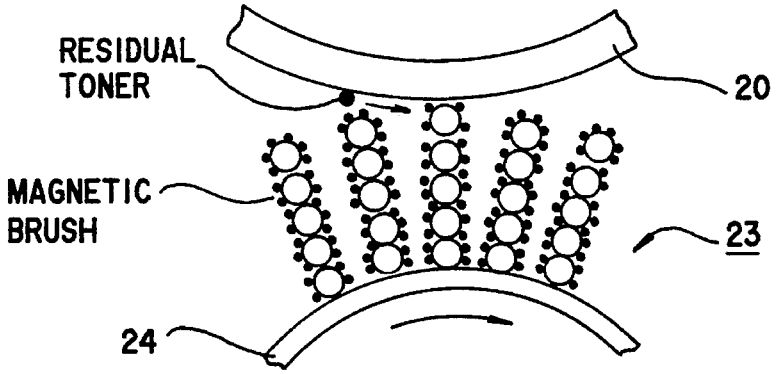
Figure 1C:
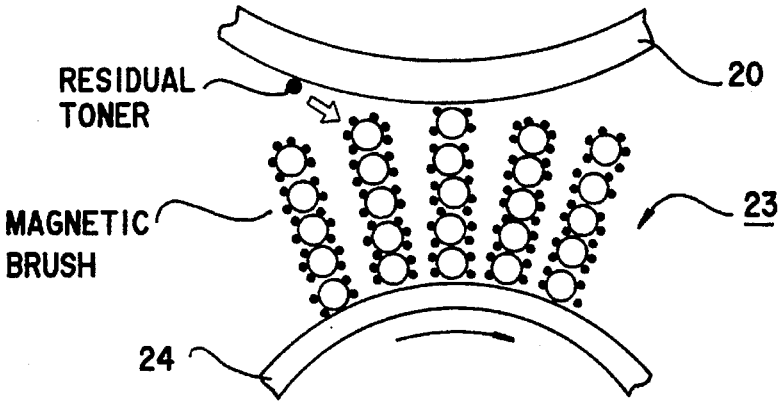

FIGS. 1A, 1B and 1C are diagrams for explaining the principle of the present invention.

In the present invention, the toner collecting power of the magnetic brush that is formed in the developing area is given in the developing process as follows. First, the scraping force by the magnetic brush is utilized as shown in FIG. 1A. Secondly, the electrostatic force between developing rollers 24 and a photosensitive drum 20 is used as shown in FIG. 1B. Thirdly, the magnetic force acting between the magnetic brush and the toners are used as shown in FIG. 1C.

Figure 2:
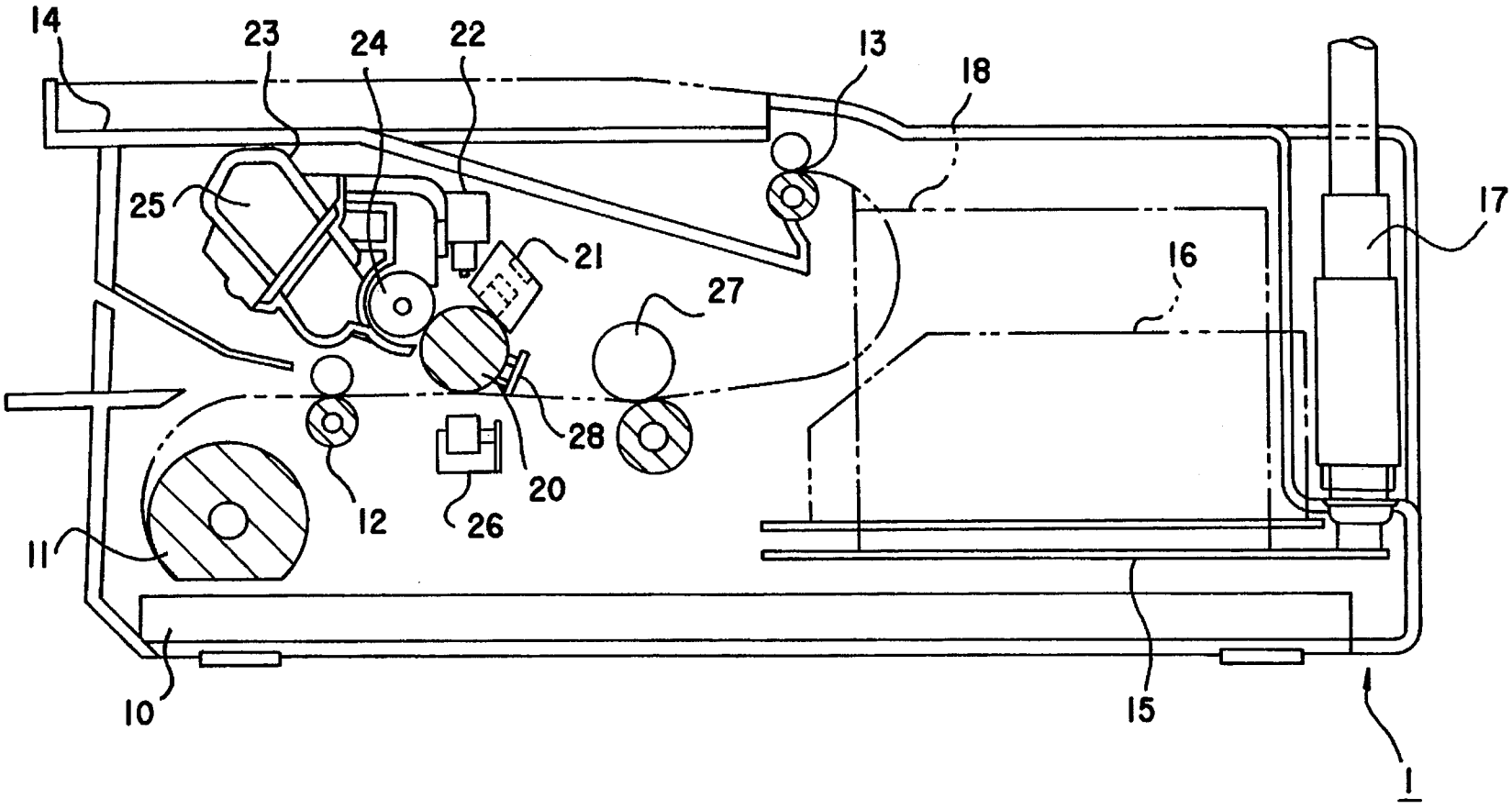
FIG. 2 is a structural diagram of a printer according to one embodiment of the present invention.
Figure 3:
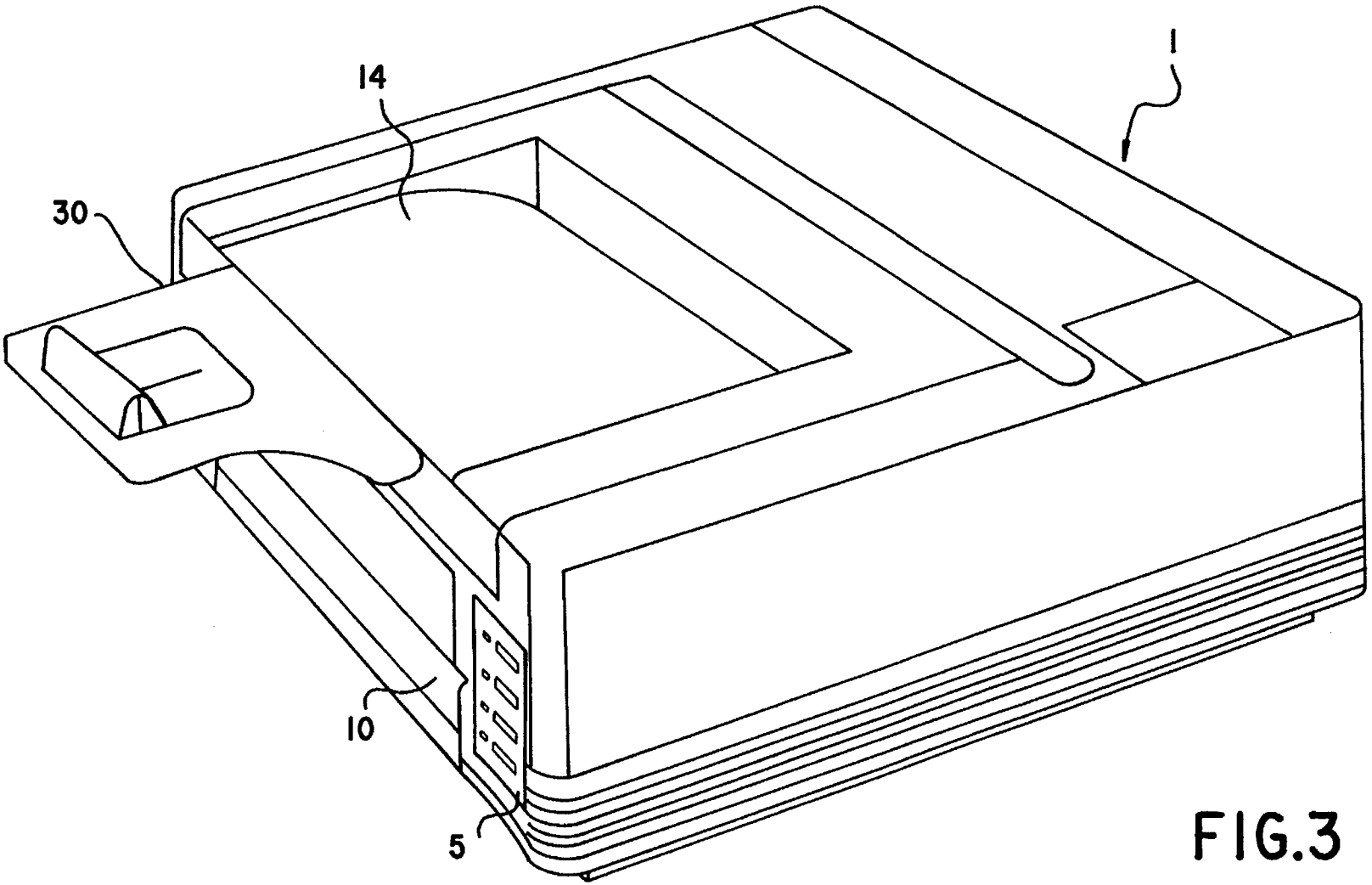
FIG. 3 is a diagram showing the apparatus in FIG. 2 in a horizontal position.
Figure 4:
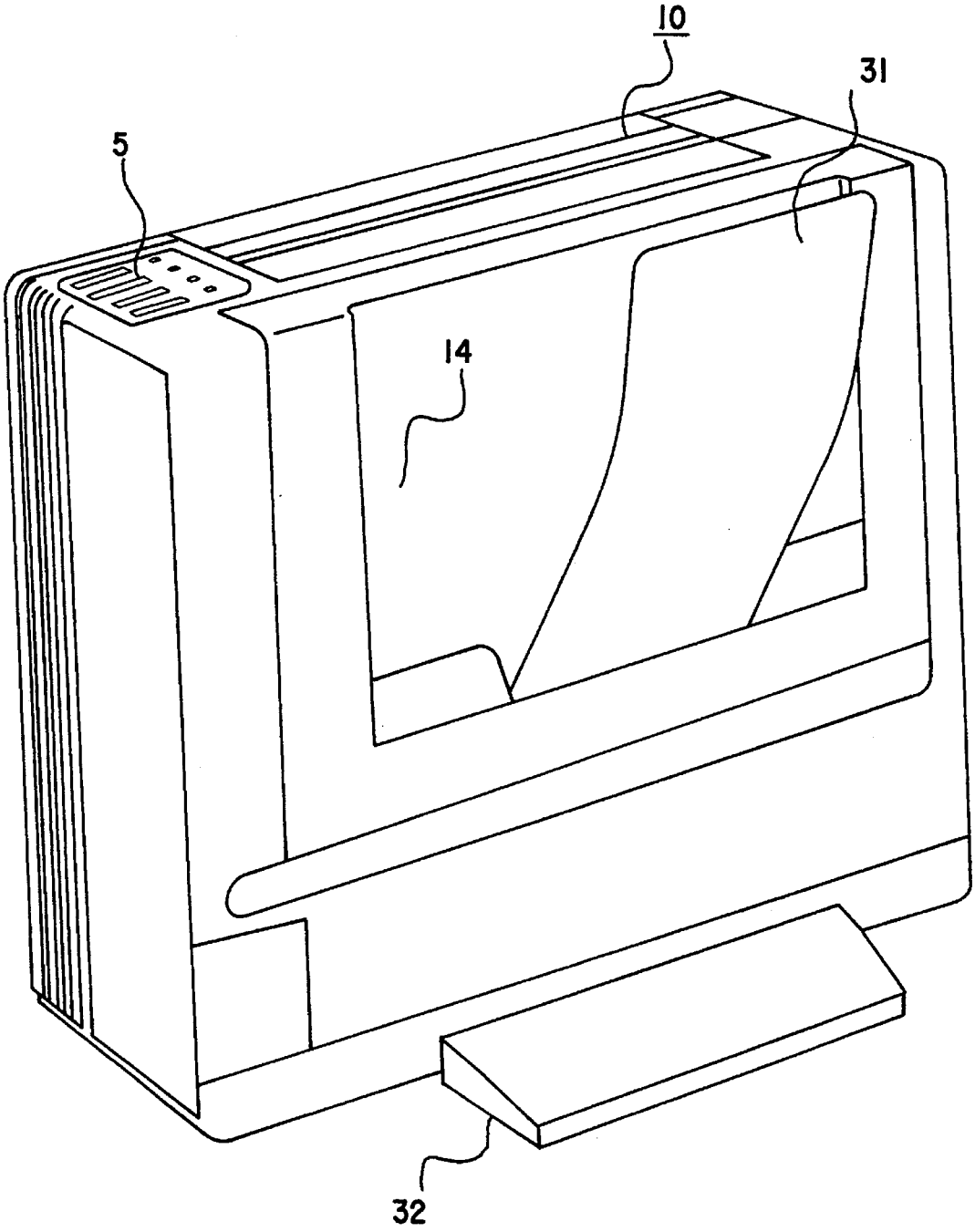
FIG. 4 is a diagram showing the apparatus in FIG. 2 in an upright position.

FIG. 2 is a structural diagram of an image forming apparatus 1 according to one embodiment of the present invention, FIG. 3 is a diagram showing the apparatus 1 in FIG. 2 in a horizontal position, and FIG. 4 is a diagram showing the apparatus in FIG. 2 in an upright position. Those diagrams show an electrophotographing printer as the image forming apparatus.

Referring to FIG. 2, the photosensitive drum 20 is an aluminum drum on which a functionally separate organic photosensitive body is coated about 20 microns thick. FIGS. 1A, 1B and 1C illustrate this photosensitive drum 20 having an outside diameter of 24 mm and rotating at a peripheral speed of 25 mm/s in the counterclockwise direction indicated by the arrow. Referring to FIG. 2, a precharger 21 uniformly charges the surface of the photosensitive drum 20 and is a non-contact type charger constituted of a Scorotron. This precharger 21 charges the surface of the photosensitive drum 20 with −580 V.

An optical unit 22 exposes the photosensitive drum 20 to image light to form an electrostatic latent image. This optical unit 22 in use is an LED optical system which has an LED array combined with a self-focus array. This optical unit 22 exposes the photosensitive drum 20 to image light in accordance with an image pattern to form an electrostatic latent image. The potential of the latent image portion becomes −50 to −100 V.

A developing unit 23 supplies charged toners to the electrostatic latent image on the photosensitive drum 20 to provide a visible toner image. This developing unit 23 will be discussed later with reference to FIG. 5 and subsequence drawings. The developing roller 24 feeds a developer to the photosensitive drum 20. A toner cartridge 25, which is filled with magnetic toners, is detachably attached to the developing unit 23. The toner cartridge 25 is exchangeable in a toner empty status to supplement magnetic toners to the developing unit 23.

A transfer unit 26 is constituted of a corona discharger. This transfer unit 26 electrostatically transfers the toner image on the photosensitive drum 20, onto a sheet. The operational principle is to apply a voltage of +3 KV to +6 KV to a corona wire from a power supply so that electric charges will be generated by corona discharging. The back of the sheet is charged with the electric charges so that the toner image on the photosensitive drum 20 is transferred on the sheet P. It is desirable that this power supply be a constant current source which supplies a constant amount of charges to the sheet to thereby reduce the deterioration of the transfer efficiency due to the environmental conditions.

A fixing unit 27 thermally fixes the toner image on the sheet. This fixing unit 27 comprises a heat roller having a halogen lamp incorporated therein as a heat source, and heat rollers (backup rollers), and heats the sheet to fix the toner image on the sheet.

A uniform distribution brush 28 is a conductive brush, which, when in contact with the photosensitive drum 20, prevents the concentration of residual toners on the photosensitive drum 20 and uniformly distributes them over the drum 20 to facilitate the toner collection in the developing unit 23.

An AC voltage is applied to this uniform distribution brush 28 to remove the residual toners off the photosensitive drum 20 and place the toners again on the drum 20 to properly distribute the residual toners. Further, a voltage equal to or greater than the voltage needed to start discharging may be applied to the brush 28 to de-electrify the photosensitive drum 20, in which case a residual positive image formed by the residual charges will be eliminated.

A sheet cassette 10, which retains sheets, is detachably attached to the printer. This sheet cassette 10 is installed at the lower portion of the printer and can be attached to or detached from the printer from the front side of the printer, which is on the left-hand side in FIG. 2. Pickup rollers 11 serve to pick up sheets from the sheet cassette 10. Resist rollers 12 align the leading edge of a picked sheet when it abuts on the rollers 12 before feeding the sheet to the transfer unit 26. Discharge rollers 13 discharge the sheet after image fixing onto a stacker 14. The stacker 14 is provided on the top of the printer to receive the discharged sheet.

A printed circuit board 15 has a printer controller installed thereon. A power supply 16 supplies power to the individual sections of the printer. An interface connector 17 is connected to an external cable at one end and is inserted in the printer at the other end to be connected to the connector of the printed circuit board 15. An optional board 18 has another type of emulator circuit, font memory, etc. installed thereon.

The operation of this embodiment will be described below. After the surface of the photosensitive drum 20 is evenly charged to −580 V by the Scorotron charger 21, image exposure is performed by the LED optical system 22 to form an electrostatic latent image with the background portion charged to −580 V and the exposed or printing portion charged to −50 to −100 V, on the photosensitive drum 20.

A developing bias voltage (−450 V) is applied to sleeve 241 of the developing roller 24 of the developing unit 23. Therefore, the electrostatic latent image is developed by magnetic polymerization toners, which have previously been stirred with carriers to have been charged negatively, in the developing unit 23, yielding a toner image.

Meanwhile, a sheet is picked up from the sheet cassette 10 by the pickup roller 11 and its leading edge is aligned by the resist roller 12 before being sent to the transfer unit 26. The toner image on the photosensitive drum 20 is transferred onto the sheet by electrostatic force by the transfer unit 26. The toner image on the sheet is fixed by the fixing unit 27, and is fed along an U-shaped feeding path to be discharged on the stacker 14 by the discharge roller 13.

After the image transfer, the distribution brush 28 distributes the residual toners on the photosensitive drum 20 and removes the residual charges. The residual toners on the drum 20 pass through the Scorotron charger 21 and LED optical system 22 to reach the developing unit 23 and are collected by the developing roller 24 at the same time as the next developing process starts. The collected toners will be used again in the developing unit 23.

Because of no cleaner used and other reasons, this printer will be designed very compact and will be easily placed on the top of a desk as a personal-usage printer. Further, this printer can be placed in a horizontal position with the sheet cassette 10 extending in parallel to the sitting surface, as shown in FIG. 3. In this diagram, an operation panel 5 is provided on the front face of the printer to indicate the operation of the printer. A sheet guide 30 is provided at the distal end of the stacker 14. This sheet guide 30 serves to press and align the leading edge of the sheet that is to be discharged on the stacker 14.

In this embodiment, the sheet cassette 10 can be attached to and detached from the front side of the printer and the operation panel 5 is operable also from the front side. In addition, the sheet is discharged to the front of the printer.

As shown in FIG. 4, image formation is possible in an upright position where the interface connector 17 of the printer in FIG. 2 is provided on the sitting surface, and the sheet cassette 10 is set upright to be perpendicular to the siting surface. This reduces the sitting space further. At this time, a sheet presser 31 may be provided on the stacker 14 to press sheets to be discharged on the stacker so that the sheets will not fall down even when the printer is placed upright. If a stand 32 is provided at the sitting surface side of the printer as illustrated, the printer even in an upright position stay stably.

Even without the cleanerless process, as the precharger 21 and the transfer unit 26 are constituted of a non-contact type discharger, the toners on the photosensitive drum 20 will not stick on those units, so that the uniform charging and image transfer can be accomplished stably.

Figure 5:
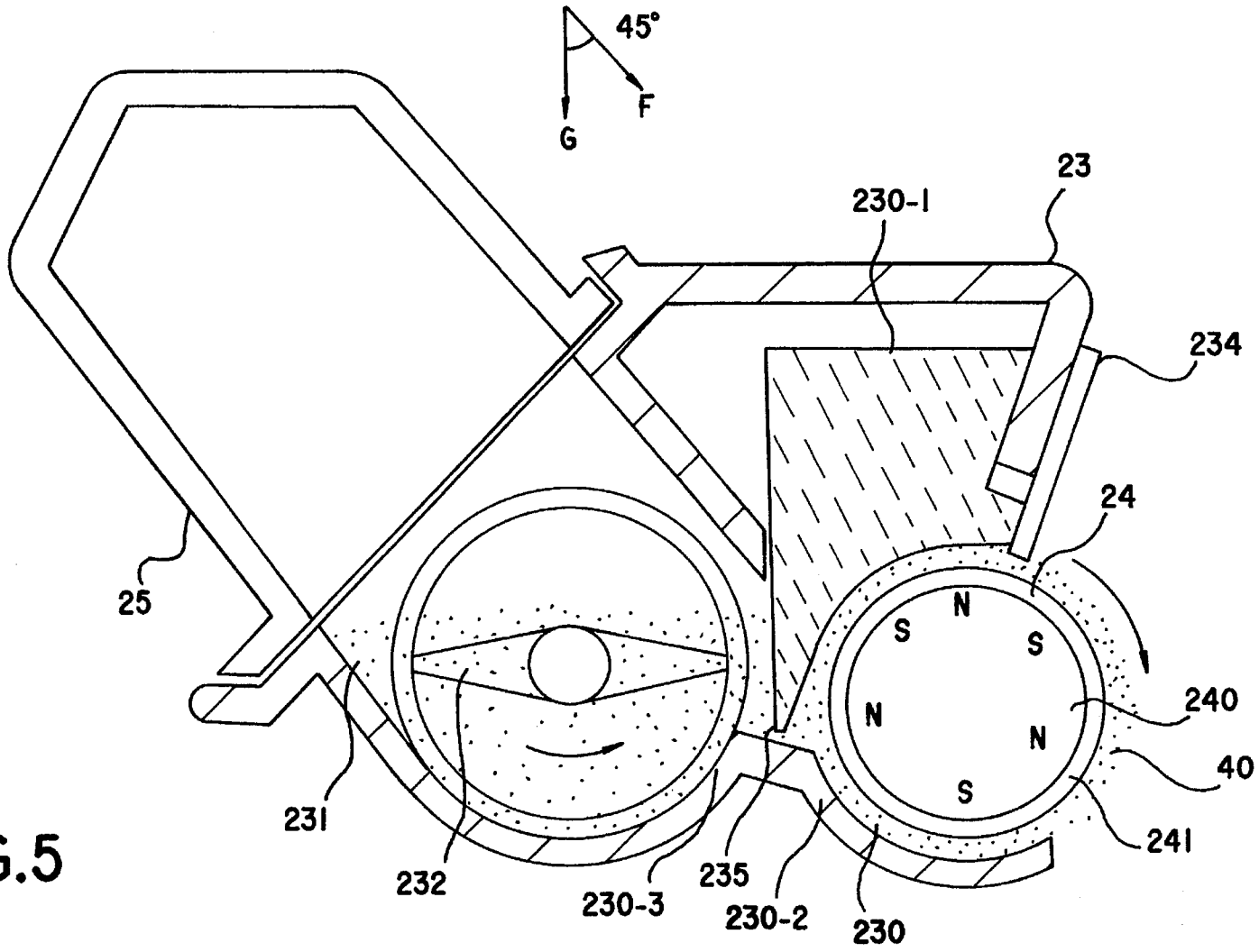
FIG. 5 is a structural diagram of a developing unit in FIG. 2.
Figure 6:
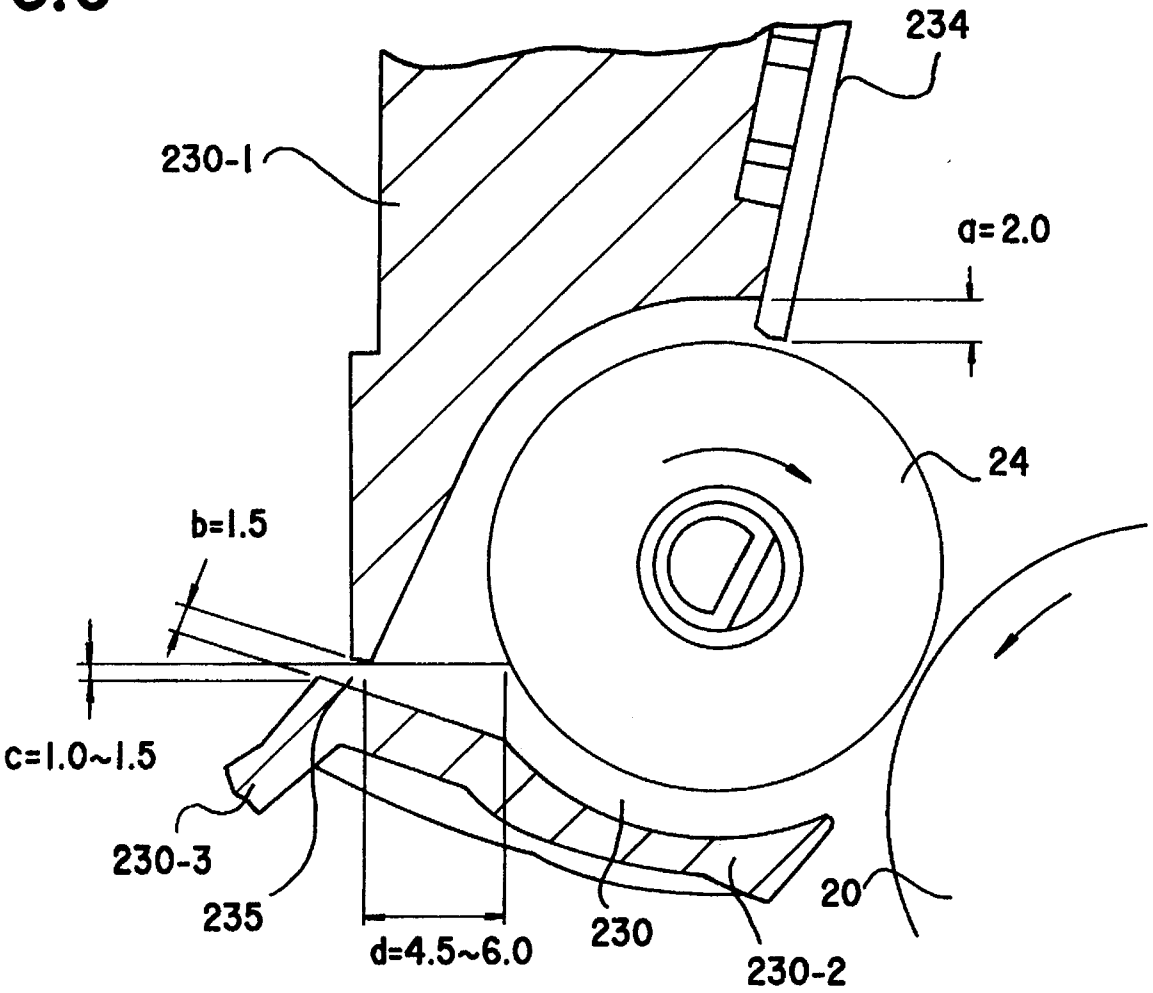
FIG. 6 is a cross section showing the essential portions of the developing unit in FIG. 5.
Figure 7:
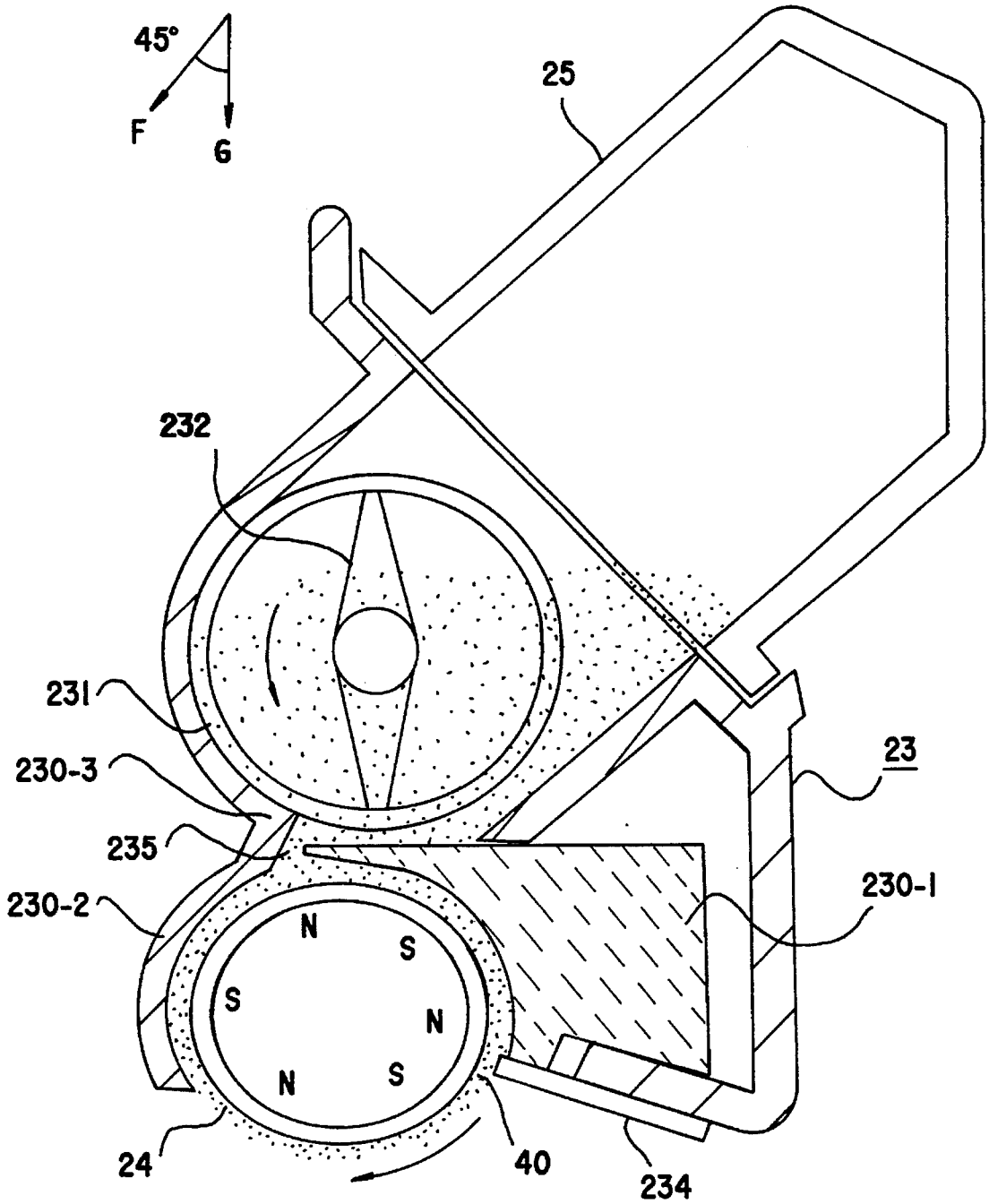
FIG. 7 is a diagram showing the developing unit in FIG. 5 in an upright position.
Figure 8A:
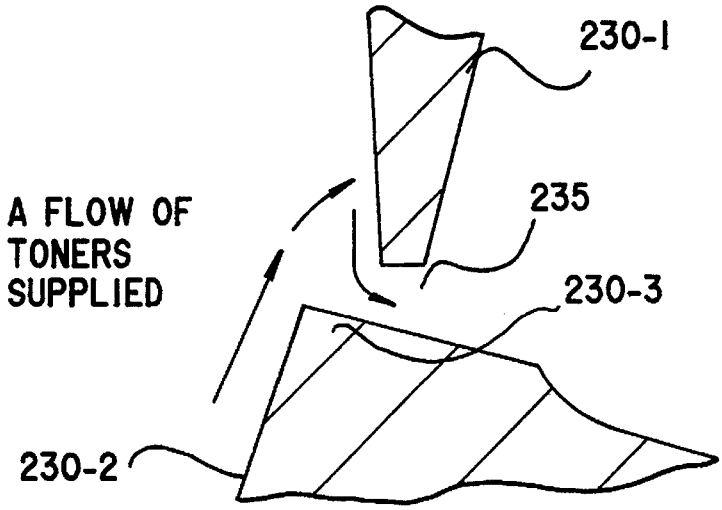
FIGS. 8A and 8B are diagrams for explaining the operation of the developing unit according to the present invention.
Figure 8B:
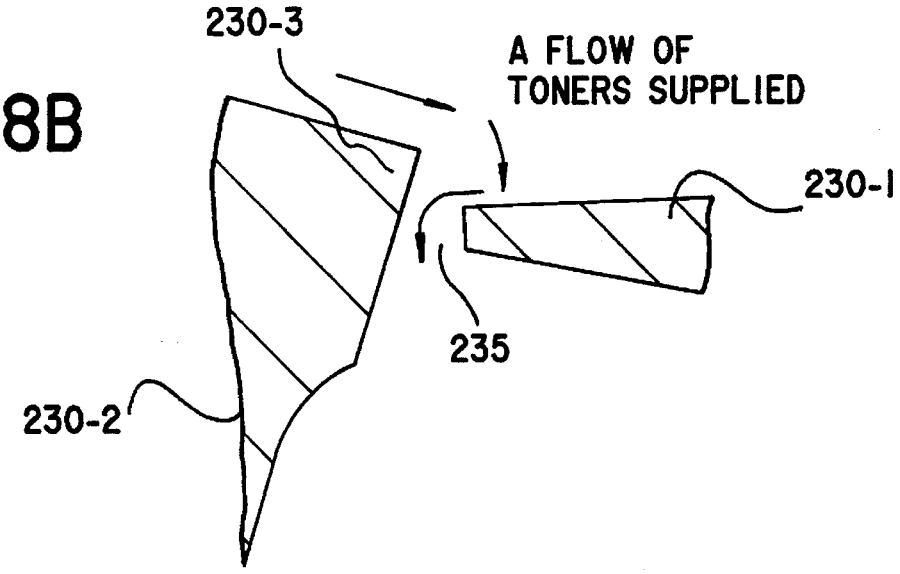
Figure 9:
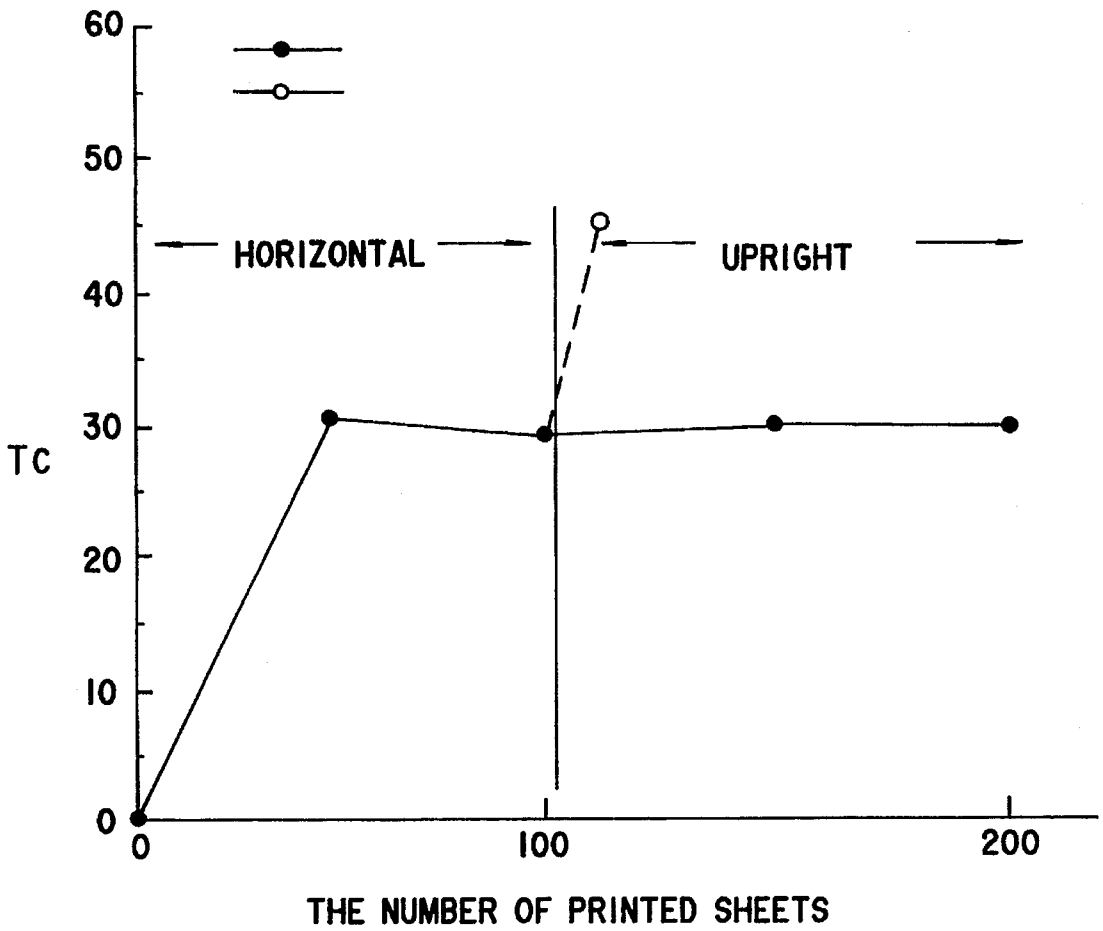
FIG. 9 is a characteristic chart of the image forming operation of the present invention.

FIG. 5 is a structural diagram of the developing unit in FIG. 2, FIG. 6 is a cross section showing the essential portions of the developing unit in FIG. 5, FIG. 7 is a diagram showing the developing unit in FIG. 5 in an upright position, FIGS. 8A and 8B are diagrams for explaining the toner supply operation, and FIG. 9 is a characteristic chart of the image forming operation of the present invention.

In FIG. 5, the developing roller 24 is constituted of a magnetic roller, which has the metal sleeve 241 and a magnet roller 240 disposed inside the sleeve 241. The developing roller 24 feeds a magnetic developer (to be described later) by the rotation of the sleeve, with the magnet roller 240 inside the sleeve 241 secured. The developing roller 24 is 16 mm in diameter and rotates at a speed (75 mm/s) three times faster than the peripheral speed of the photosensitive drum 20.

A developing room 230 is formed around the developing roller 24. The developing room 230 is filled with a 1.5-component developer, which is a mixture of magnetic carriers and magnetic toners. This developing room 230 is defined by an upper partition member 230-1 and a bottom 230-2, and has a constant volume.

When a constant amount of magnetic carriers is supplied to the developing room 230, the amount of the magnetic toners in this room 230 also becomes constant. As the amount of the developer in the developing room 230 is constant, the toner density becomes constant when the used magnetic toners are supplemented from a toner hopper 231. This can eliminate the need to control the toner density. In other words, the toner density is automatically controlled within a predetermined range by supplementing the amount of the magnetic carriers, which is equivalent to the control point for the toner density, into the developing room 230.

Because the developer is always fully present around the developing roller 24 in this developing room 230, even with the printer placed upright, the developer in the developing room 230 will not concentrate at some part, thus preventing insufficient supply of the developer to the developing roller 24.

The magnetic carriers in the developer are magnetite carriers of an average particle size of 40 microns. The magnetic toners are polymerization toners of an average particle size of 7 microns. The polymerization toners have a uniform particle size and have a sharp particle distribution, so that adhesion between the sheet and the toner image on the photosensitive drum 20 becomes uniform in the transfer process. Accordingly, the electric field in the transfer section becomes uniform, thus improving the transfer efficiency more than the conventional pulverizing method. The transfer efficiency of the pulverized toners is 60 to 90% while the transfer efficiency of the polymerization toners is 90% or above.

Although the proper toner density of the toners is 5 to 60% by weight, it was set to 30% by weight in this embodiment.

A doctor blade 234 serves to adjust the supply amount of the developer by the developing roller 24 so that the developer will not be supplied excessively or insufficiently to the electrostatic latent image on the photosensitive drum 20. The adjustment is performed by the gap between the edge of the doctor blade 234 and the surface of the developing roller 24; the gap is normally adjusted to about 0.1 to 1.0 mm.

The toner hopper 231 is filled only with magnetic toners and has a supply roller 232 inside. The rotation of the supply roller 232 supplies the toners to the developing room 230.

The toners supplied to the developing room 230 are stirred therein and rubbed against the carriers to be charged to a predetermined potential of a given polarity by the developer supplying force of the sleeve of the developing roller 24, the magnetic force of the developing roller 24 and the developer regulating performance of the doctor blade 234. In this embodiment, the toners are charged negatively to control the charging systems of the carriers and the toners.

Further, the gap between the partition member 230-1 and the developing roller 24 at the upstream side of the blade 234 is set smaller than the tips of the bristles of the magnetic brush formed on the developing roller 24. In this example, the gap a is set to 2.0 mm as shown in FIG. 6. Accordingly, the magnetic brush on the developing roller 24 is restricted by the partition member 230-1 and receives force by the rotation of the developing roller 24. This increases the stirring of the developer in the developing room 230, ensuring a stable amount of toner charging even within a high toner-density range.

This gap is uniformly set around the developing roller 24, so that the same charging effect will be obtained regardless of the upright position or horizontal position of the printer.

A toner supply passage 235, which is defined by the distal end of the partition member 230-1 and the bottom 230-2, is provided between the toner hopper 231 and the developing room 230. The width b of the toner supply passage 235 is 1.5 mm as apparent from FIG. 6. The toners in the toner hopper 231 are supplied along the toner supply passage 235 to the developing room 230.

The bottom 230-2 that defines the developing room 230 has a projection 230-3 protruding from the toner hopper 231 in the toner supply passage 235. The bottom 230-2 has an inclined face extending upward from the side of the photosensitive drum 20. The gap c between the distal end of the projection 230-2 and the distal end of the partition member 230-1 is set to 1.0 to 1.5 mm as shown in FIG. 6. That is, the bottom 230-2 is inclined by this amount. In addition, the distance d between the distal end of the partition member 230-1 and the developing roller 24 is set to 4.5 to 6.0 mm.

Next, the angles of both walls of the toner cartridge 25 and the toner hopper 231 are set to about 45 degrees with respect to the gravitational direction, ensuring the angle of the toner flow to 45 degrees. Even with the printer set upright, therefore, the toners will be supplied smoothly as will be described later.

The operation of this developing unit will be described below. FIG. 5 shows the state of the developing unit when the printer is set in a horizontal position, as shown in FIG. 3, with the angles of the walls of the toner cartridge 25 and the toner hopper 231 are set to about 45 degrees with respect to the gravitational direction. Therefore, the toners flow toward the bottom of the toner hopper 231 to be smoothly supplied to the supply roller 232.

In this horizontal position, the toners flow toward the bottom in the toner hopper 231 due to gravitation, so that the supply roller 232 scrapes off the toners at the bottom of the toner hopper 231. At this time, the toners lifted by the supply roller 232 temporarily abut on the partition member 230-1 by the projection 230-3 of the bottom 230-2 and then enter the toner supply passage 235, as shown in FIG. 8A. As a result, only the toners supplied by the toner supply roller 232 enter the toner supply passage 235. The toner abutting portion of the partition 230-1 serves as a buffer so that the force of the toner supply roller 232 will not directly influence the toner supply passage 235. This prevents excessive supply of the toners and allows just the right amount of toners needed to be supplied to the developing room 230.

As the bottom 230-2 is tilted with respect to the rotational direction of the developing roller 24 in this case, the magnetic brush of the developing roller 24 after passing the photosensitive drum 20 and the carriers that have escaped the brush will not leak into toner hopper 231 along the toner supply passage 235 through the bottom 230-2. It is therefore possible to prevent the amount of the starter carriers in the developing room 230 from decreasing and accomplish stable image development with the 1.5-component developer.

In the state of the developing unit shown in FIG. 7 with the printer set upright as in FIG. 4, the angles of the walls of the toner cartridge 25 and toner hopper 231 are also set to about 45 degrees with respect to the gravitational direction. Even in this upright position, therefore, the toners can be smoothly supplied to the toner supply roller 232.

In consideration of the angle of repose, the proper angles of the walls of the toner cartridge 25 and toner hopper 231 would be about 45 degrees ±10 degrees with respect to the gravitational direction in order to feed the toners by the dead weight, and 45 degrees ±5 degrees, preferably, would produce good results.

At this time, the toners stay on the toner hopper side of the partition member 230-1 and will easily fall off the toner supply passage 235 into the developing room 230 as shown in FIG. 7. But, the projection 230-3 of the bottom 230-2 restricts the falling of the toners from the toner supply passage 235 as shown in FIG. 8B so that the toners would hardly drop. In other words, the supply of the toners is dependent on the rotational force of the toner supply roller 232.

As shown in FIG. 8B, the toners pressed by the toner supply roller 232 temporarily abut on the partition member 230-1 by the projection 230-3 of the bottom 230-2 and then enter the toner supply passage 235. As a result, only the toners supplied by the toner supply roller 232 enter the toner supply passage 235. The toner abutting portion of the partition 230-1 serves as a buffer so that the force of the toner supply roller 232 will not directly act to supply the toners. This prevents excessive supply of the toners and allows just the right amount of toners needed to be supplied to the developing room 230.

This means that the performance of supplying the toners to the developing room 230 does not change, regardless of whether the printer is set in a horizontal position or in an upright position. Irrespective of whether the printer is set in a horizontal position or in an upright position, therefore, the toner density in the developing room 230 does not change, thus preventing a variation in image density.

In other words, the toners that enter the developing room 230 are mostly supplied by the toner supply roller 232, thus accomplishing toner supply which is not affected by the toners' fluidity in the gravitational direction. Even if the sitting direction of the printer changes, therefore, the amount of toner supply will not change, thus ensuring a stable developing operation.

With the printer in an upright position, the developer may drop from the developing unit 23. Since the magnetic two-component developer is used, however, the developer is held sticking on the developing roller by the magnetic force so that the developer hardly drops even when the printer is set upright.

When the magnetic carriers and the magnetic toners are used, particularly, the carriers and toners are both held by the magnet roller of the developing roller 24, further preventing the developer from dropping and ensuring stable image development even when the printer is in an upright position.

FIG. 9 presents a characteristic diagram showing a change in toner density Tc when printing is executed first with the printer set in a horizontal position and then with the printer in an upright position.

First, the printer was set in a horizontal position, a predetermined amount of start carriers was placed in the developing room 230 of the developing unit 23 and the developing unit 23 was then activated to conduct printing. The toners are gradually supplied to the developing room 230 from the toner hopper 231, so that as the number of printouts increases, the toner density increases. When the developing room 230 become full with the carriers and toners, the toner density was 30% by weight. Thereafter, even when the number of printouts increased, the toner density did not change.

Under this condition, the printer was then set upright and printing was conducted. The toner density remained the same as that of the previous case of the printer in a horizontal position. When the printer having the conventional 1.5-component developing unit disclosed in Japanese Unexamined Patent Publication No. 252686/1991 is set upright, the toner density increased as indicated by a white circle. That is, the toner density changed and the image density changed between the horizontal position and the upright position. This proves the stable toner supply of the present invention. Regardless of whether the printer is set in a horizontal or upright position, images will be formed without a variation in image density. The present invention will therefore provide an image forming apparatus which can be set in a horizontal position as well as in an upright position with the same printing quality.

As the developing unit 23 has the developing room 230 for retaining the developing roller 24 and the toner supply room 232 for supplying magnetic toners to the developing room 230, the toner density in the developing room 230 can be kept to a stable level to ensure the collection of the residual toners.

Since, the developing roller 24 includes the rotatable sleeve 241 and the magnetic generating member 240 having a plurality of magnetic poles along the cylindrical direction, a stable magnetic brush can be formed and can be conveyed to the photosensitive drum 20 on which the residual toners are staying.

Figure 10:
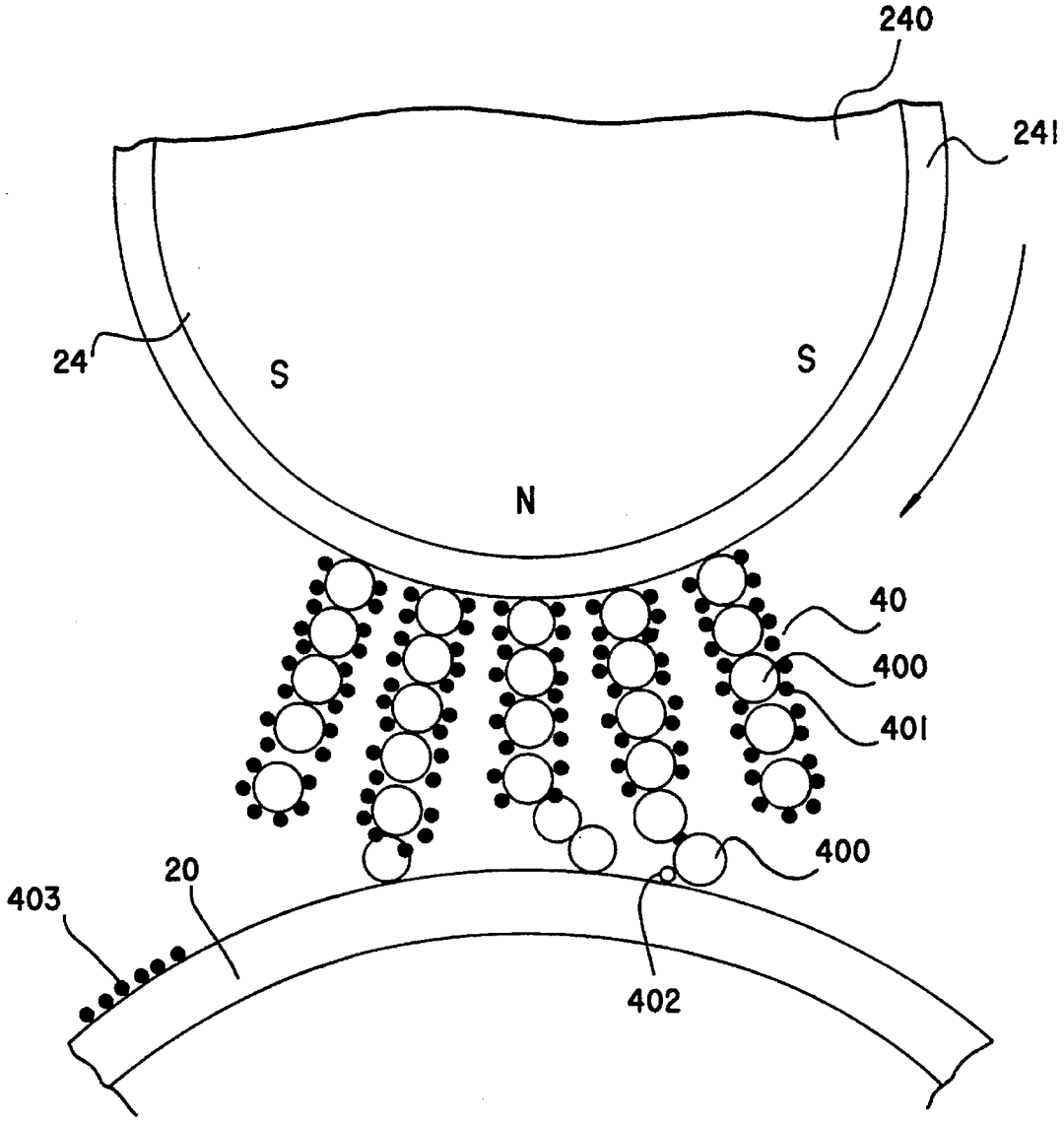
FIG. 10 is a diagram for explaining the operation of the developing unit of the present invention.
Figure 11A:
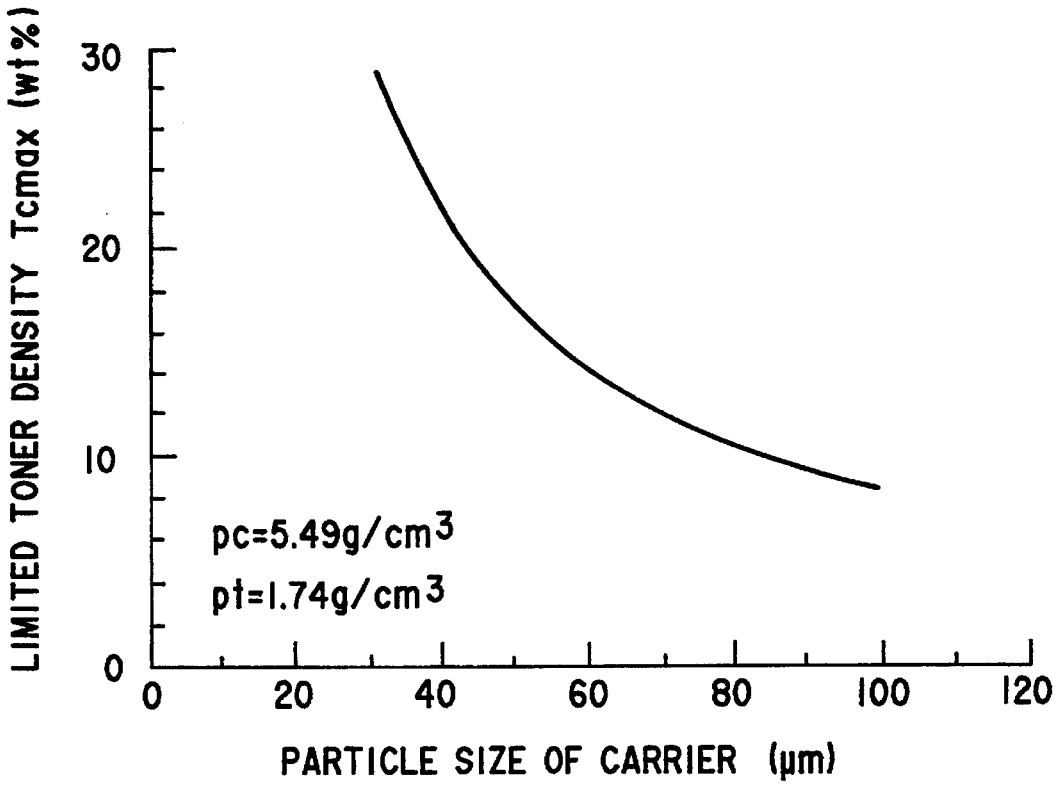
FIGS. 11A and 11B are explanatory diagrams of an allowable toner density.
Figure 11B:
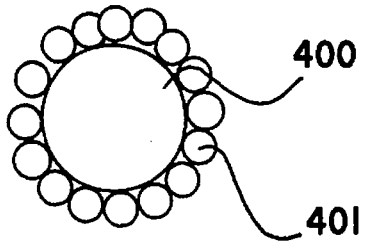
Figure 12:
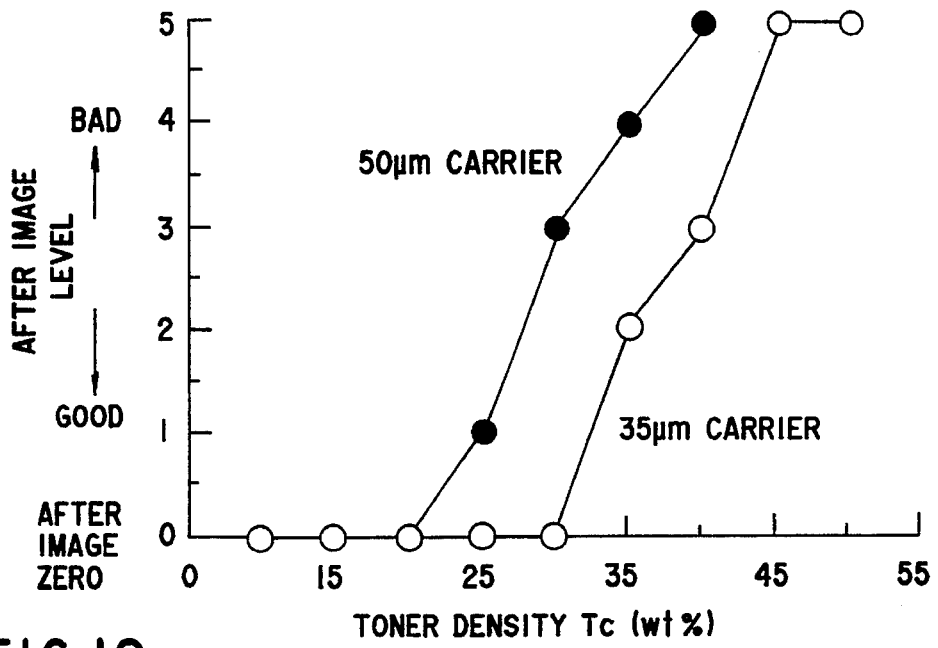
FIG. 12 is a diagram showing the relation between an afterimage and toner density.
Figure 13:
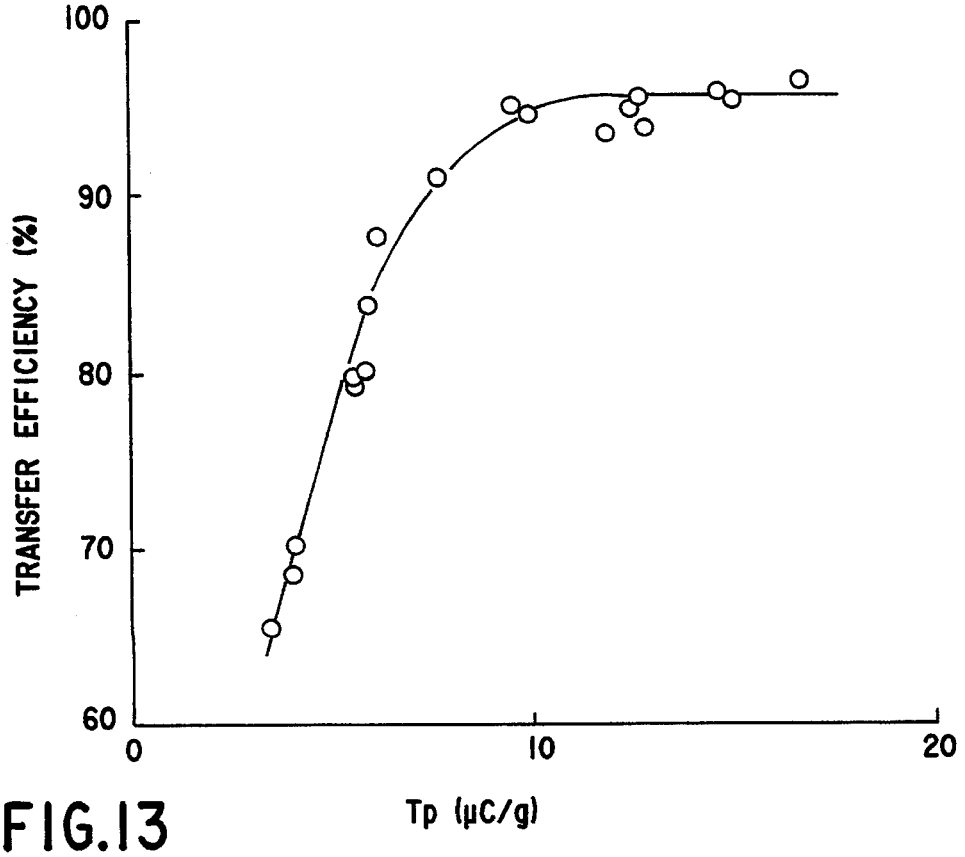
FIG. 13 is a diagram showing the relation between the amount of charges of toners and transfer efficiency.
Figure 14:
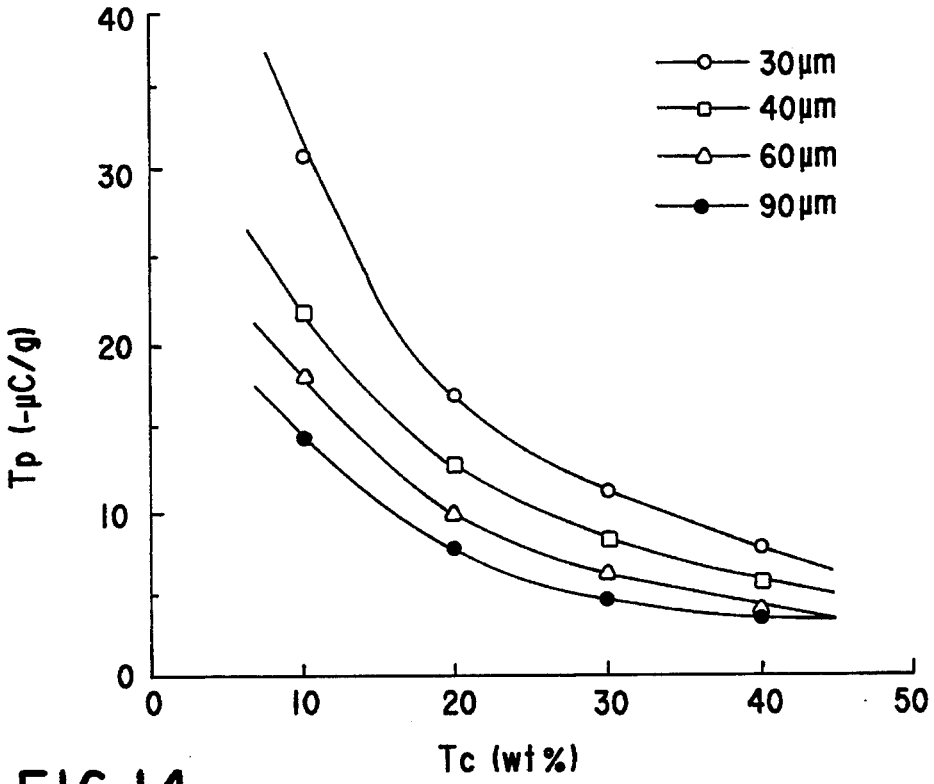
FIG. 14 is a diagram showing the relation between the amount of charges of toners and toner density.
Figure 15:
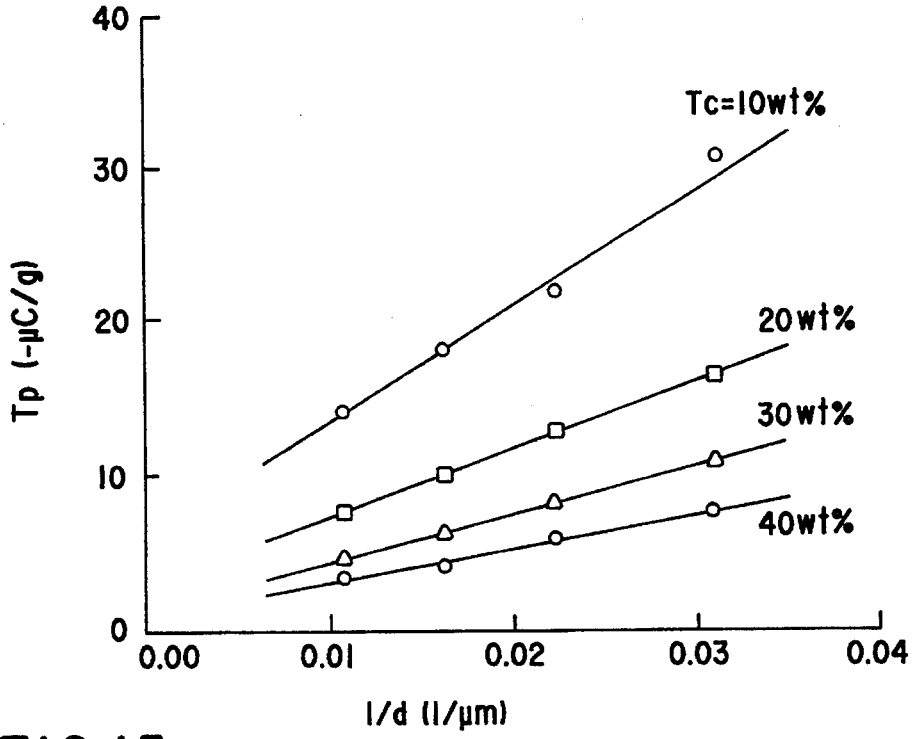
FIG. 15 is a diagram showing the relation between the reciprocal of the average particle size of carriers and the amount of charges of toners.
Figure 16:
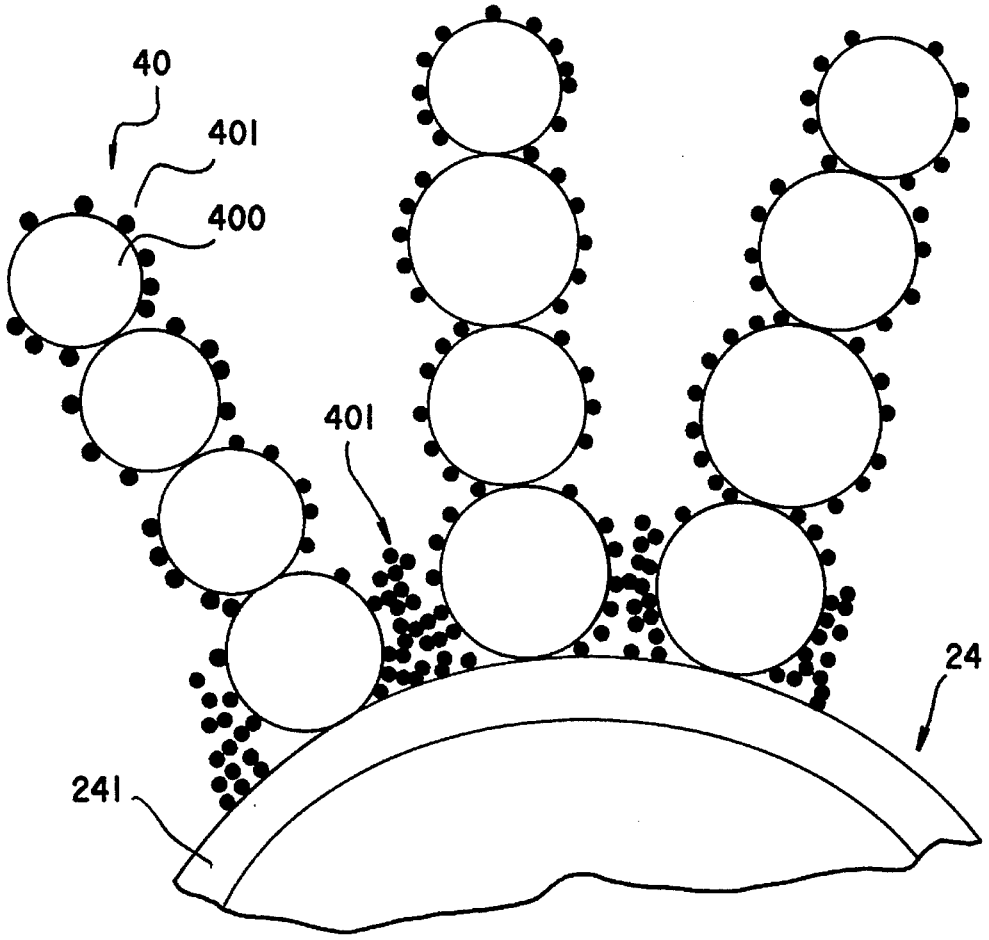
FIG. 16 is a diagram showing the state of a magnetic brush.
Figure 17:
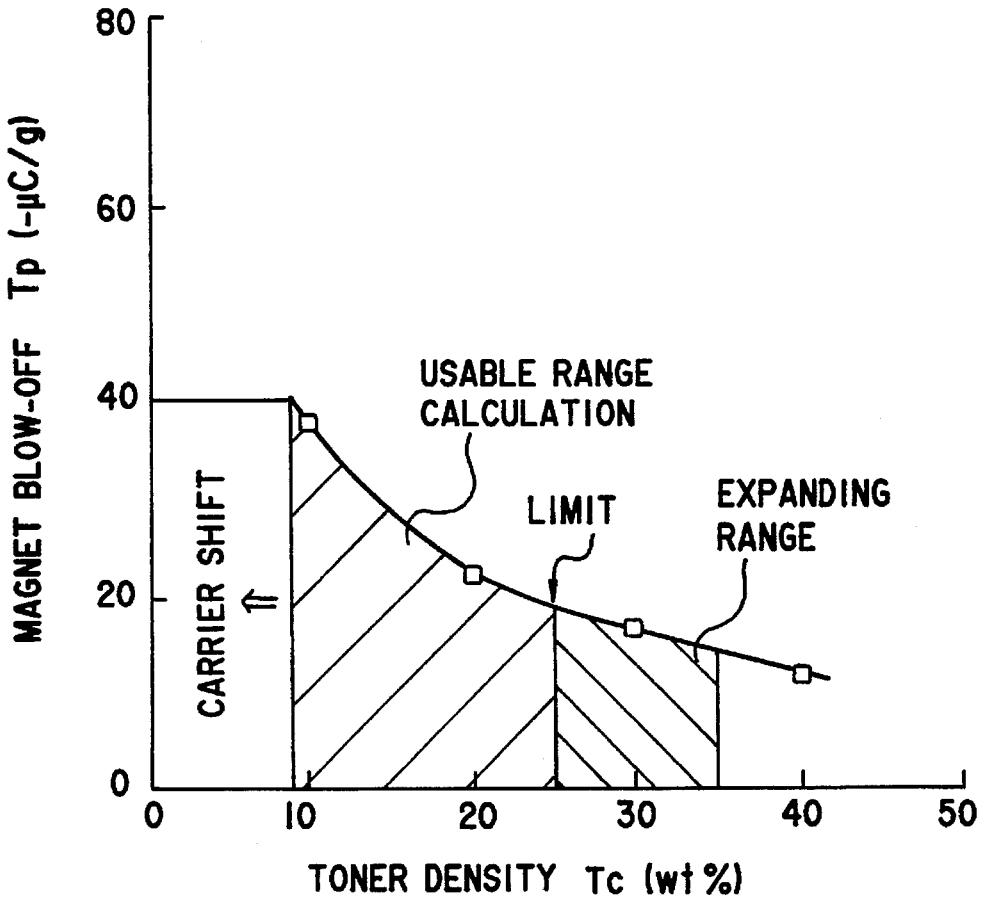
FIG. 17 is an explanatory diagram of the toner density.

FIG. 10 is a diagram for explaining the operation of the developing unit of the present invention, FIGS. 11A and 11B are explanatory diagrams of an allowable toner density, FIG. 12 is a diagram showing the relation between an afterimage and toner density according to this invention, FIG. 13 is a diagram showing the relation between the amount of charges of toners and transfer efficiency according to this invention, FIG. 14 is a diagram showing the relation between the amount of charges of toners and toner density according to this invention, FIG. 15 is a diagram showing the relation between the reciprocal of the average particle size of carriers and the amount of charges of toners according to this invention, FIG. 16 is a diagram showing the state of a magnetic brush, and FIG. 17 is an explanatory diagram of the toner density.

As shown in FIG. 10, developing roller 24 comprises the rotatable metal sleeve 241 and the magnet roller 240 secured inside the sleeve 241 as mentioned above. Thus, the developer consisting of magnetic carriers 400 and magnetic toners 401 is supplied to the position (developing area) where it contacts the photosensitive drum 20 as the sleeve 241 rotates. The magnetic force of the magnet roller 240 forms a magnetic brush 40 by which the development with the magnetic toners 401 and the collection of the residual toners 402 sticking on the photosensitive drum 20 are carried out.

The magnetic toners 401 are rubbed against the carriers 400 and thus have electrostatic charges. The magnetic toners 401 are applied with an external electric field, which is produced by the difference between the potential of the sleeve 241 and the potential of the photosensitive drum 20, and thus stick on the exposed portion (latent-image potential forming portion), thus accomplishing the image development. At this time, an electric field is acting on the unexposed portion of the photosensitive drum 20 in the opposite direction to the electric field acting on the exposed portion, so that the magnetic toners 401 will not normally stick on the unexposed portion.

But, the frictional charging of the toners and carriers may not be uniform, and the electric charges of the toners normally have some distribution pattern. This produces low charged toners which hardly have electric charges, or toners which are charged to the opposite polarity. As a result, the toners stick on the unexposed portion of the photosensitive drum 20; this phenomenon is called "background noise." Since this phenomenon occurs relatively easily as the toner density becomes high, the toner density variation should be strictly controlled to about 1% by weight in the ordinary 2-component developing system that uses non-magnetic toners.

In the developing system of the present invention that uses magnetic toners, the magnetic force of the magnet roller 240 acts to prevent the low-charged toners or toners charged to the opposite polarity from sticking on the unexposed portion. Further, only the toners highly charged selectively stick even on the exposed portion, thus suppressing the sticking of low-charged toners which are difficult to be transferred. It is therefore possible to accomplish the proper development with a wider range of the toner density of approximately 5 to 60% by weight.

In the present invention, the collection of the residual toners 403 is executed about the same time as the development is carried out. The forces that act on the residual toners 402 are the mechanical scraping force particularly of the carriers 400, the magnetic force and the electrostatic force. The present invention has an advantage over the method using non-magnetic toners in the action of the magnetic force. Even if the electric charges of the residual toners 402 decrease due to toner leakage or the like, weakening the electrostatic force, sufficient toner collection is still possible.

It is important in the cleanerless process that the toners which remain in the image transfer process should be reduced as much as possible, and the collection of the residual toners should be accomplished efficiently. The toner density is the most influential in the toner collection of the present invention which also uses the magnetic force. We will contemplate this matter further.

First, the transfer efficiency is improved in the transfer process by the magnetic polymerization toners, thus reducing the residual toners. It is known that the transfer efficiency is affected by the amount of charges of the toners. This is because that the electrostatic force from the sheet that acts on the toners varies. This is shown in FIG. 13 that shows the relation between the amount of charges of toners and the transfer efficiency. It is understood from the relation that the absolute value of the amount of charges of toners should preferably be 8 μC/g or greater.

FIG. 14 shows the relation between the amount of charges of the developer toners (Tp) and the toner density when magnet carriers of different average particle sizes are used. As apparent from this diagram, the lower the toner density is, the greater the amount of charges becomes. This is desirable from the viewpoint of the transfer efficiency.

Similarly, it is considered better to improve the toner collecting effect if the toner density is low for the following reason. As the toner density becomes lower and the amount of charges increases, the electrostatic force that acts in collecting toners increases. Accordingly, the amount of toners sticking on the carrier surface decreases, increasing the toner scraping power of the magnetic brush.

As shown in FIG. 14, when the toner density is too low, the amount of charges with respect to the toner density changes drastically, so that a slight change in toner density will cause a significant change in image density. This requires more strict control on the variation range for the toner density, and is therefore not desirable as the developing system. Further, the carriers have charges which are about equal in amount to the charges of the toners but of the opposite polarity. If the amount of charges of the carriers increases, the carriers easily stick on the photosensitive drum 20. This shortcoming becomes prominent when the toner density is less than 10% by weight.

According to the present invention with a simple structure which does not perform strict toner density control, therefore, the apparatus should be used with a toner density of at least 10% by weight. Particularly, the toner density of around 25% by weight appears most preferable.

The upper limit of the toner density will now be considered. First, it is considered that as the particle size of the carriers becomes smaller, the amount of charges increases, thus allowing the apparatus to be used in a wider range of the toner density. This point will be discussed in greater details.

FIG. 12 shows the relation between the toner density and an afterimage which is formed due to insufficient collection of residual toners, when printing is performed with carriers having different particle sizes. The afterimage level "0" indicates the case where no afterimage is formed, and the afterimage level "1" is normally undetectable and is considered negligible for general usages. At the afterimage level "2," an afterimage may be slightly detectable, and at the afterimage level "3" or above, an afterimage is clearly detectable.

It is apparent from this relation that the upper limit of the toner density is 25 to 30% by weight for the carrier particle size of 50 μm and the toner density can be increased up to 35% by weight when the particle size of the carriers is 35 μm. One may understand this relation in consideration of the following points.

FIG. 15 shows the characteristic in FIG. 14 which is replotted as the relation between the reciprocal of the average particle size of the carriers, 1/d, and the amount of charges of the toners. It is apparent from FIG. 15 that the amount of charges is nearly proportional to 1/d for both toner densities. As the specific surface area of the carriers of a true sphere or uniform particle size is apparently proportional to 1/d, the amount of charges of the toners is also nearly proportional to the specific surface area of the actual carriers. That is, as the carrier surface that the toners can contact increases, the amount of charges of the toners increases.

It is also considered that as the surface area of the carriers increased, the mechanical toner collecting power of the magnetic brush increased. Due to the above two reasons, the margin for the toner density (toner density allowable range) with respect to an afterimage was widened for the carrier particle size of 35 μm.

It is generally easier to understand the influence of the particle size of the carriers when one considers the covering ratio of the toners, E, with respect to the carrier surface. For the sake of simplicity, we will consider the case where the carriers and toners are both uniform and true spheres and the carrier surface is covered with the toner smaller than the carriers.

It is known that the toner density Tc and the ratio E of covering the carrier surface with toners are approximately expressed by the following equation (See "Charge Control of Powdery Developer for Laser Printer" by Seiji Okada, et al., the Japan society for the Promotion of Science, 142nd Meeting, 17th Joint Study Report, p. 1 (1980)).

$$E = \frac{100 \cdot Tc \cdot p_c \cdot d_c \cdot S}{\pi \cdot (100 - T_c) \cdot p_t \cdot d_t^3} \ (\%) \tag{1}$$

Here, $$S = \frac{\pi \cdot d_c^2}{2} \left( 1 - \frac{d_c (d_c + 2d_t)}{d_c + d_t} \right)$$

where

Tc: toner density (% by weight)

$p_c$, $p_t$: densities of carriers and toners (d/cm$^3$)

$d_c$, $d_t$: average particle sizes of carriers and toners (cm)

The toner density (limiting toner density, Tcmax) when the carrier surface is completed covered with one layer of toners will be derived from the above equation with E=100%, and is expressed by the following equation.

$$Tcmax = \frac{100\pi \cdot p_t \cdot d_t^3}{p_c \cdot d_c \cdot S + \pi \cdot p_t^3 \cdot d_t^3} \ (\text{\% by weight}) \tag{2}$$

FIG. 11A shows a calculated change in Tcmax according to the carrier particle size with pc set to 5.5 g/cm$^3$ and pt set to 1.7 g/cm$^3$. From the diagram, the limiting toner densities calculated for the carrier particle sizes 35 μm and 50 μm are 26% by weight and 18% by weight, by which the difference between the limit values of the toner density shown in FIG. 12 can be explained.

Therefore, as shown in FIG. 17, the upper limit of the toner density in the image development and toner collection in the present invention can theoretically be defined almost by the limiting toner density. The computed value is slightly smaller than the upper limit obtained from the characteristic in FIG. 12, and would be about 120 to 130% in terms of the covering ratio E.

This may be because that some of the toners 401 do not contact the carriers 400 and are held near the sleeve 241, so that a sufficient carrier surface is maintained at the tip of the actual magnetic brush, which contributes to the image development and toner collection, even if the toner density is above the computed limiting toner density.

In view of the above, printing without an afterimage may be accomplished by setting the toner density to about 130% or smaller in terms of the covering ratio in the image development and toner Collection of the present invention. In FIG. 17, the upper limit of the limiting toner density is considered to be 35% by weight for the carriers with a particle size of 35 μm. It is preferable to use the present image forming apparatus under the limiting toner density.

Let us now consider the toner density from the viewpoint of the developing mechanism.

In some 1.5-component developing mechanisms, the sleeve and the magnet roller in the sleeve both rotate. In this type of mechanism, each carrier in the magnetic brush formed on the sleeve rotates while revolving around the sleeve.

As the carriers near the surface of the photosensitive body rotate, the carriers contact the photosensitive body while rotating. The carriers therefore contact the photosensitive body with a large contact area with respect to the photosensitive body per unit time. Even when the toner density is high, the force of scraping the residual toners is large, thus reducing the density level of an afterimage.

Since this developing mechanism should also rotate the magnet roller, the number of required parts increases and the cost increases accordingly. For an inexpensive developing apparatus or image forming apparatus with a reduced number of parts, the magnet roller should be fixed as in the embodiment shown in FIG. 5.

In this case, the bristles of the magnetic brush 40 (carrier chain) formed on the sleeve 241 move on the sleeve 241 while yielding, so that each carrier 400 only revolves and does not rotate.

Unlike the previous case, the carrier contacts the photosensitive body at only one point, which means a small contact area between the photosensitive body and the carrier located near the photosensitive body per unit time. It is therefore undesirable to increase the toner density.

There are three forces to remove the residual toners from the photosensitive body: the first one is the magnetic attraction of the magnetic toners by the magnetic force of the magnet roller and the carriers, the second is the electrostatic attraction between the carriers and the magnetic toners, and the third is the scraping force by the carrier surface, as mentioned earlier. Of those three forces, the third one, the scraping force by the carrier surface, is important in removing the residual toners.

As mentioned above, the ratio of covering the carrier surface with the toners tends to gradually increases to near the limiting toner density as the toner density increases. When the toner density reaches a certain value above the limiting toner density or exceeds that value, the toners' covering ratio does not increase. In this case, actually, the amount of the carriers decreases while the amount of the toners per unit volume increases.

When the toner density exceeds the limiting toner density significantly, therefore, the total area on the carrier surface per unit volume, which is not covered with the toners, decreases even though there is some uncovered portion, from the microscopic viewpoint of a single carrier. This greatly reduces the carriers' scraping power.

In view of the above, it is desirable to set the toner density to near the limiting toner density, 25 to 30% by weight for the 35 μm carriers, so that the amount of the carriers per unit volume becomes a predetermined amount when fixed magnet roller are used.

As the volume of the developing room 230 is constant, the toner density can be set so by properly setting the amount of the starter carriers that are supplied to this developing room 230.

With regard to the physical properties of the magnetic polymerization toners, it is desirable that the saturated magnetization is 15 to 35 emu/g and the coercive force is 140 to 240 Oe. It is preferable that the saturated magnetization be 20 to 30 emu/g, and the coercive force is 160 to 205 Oe with the dielectric loss of 0.2 or below, more preferably, 0.1 or below.

As the toner density of the developer is set to the limiting toner density or smaller than the limiting toner density, the limiting amount of the magnetic toners are not attracted to the carriers on the magnetic brush. It is therefore possible for some external toners to stick on the carriers of the magnetic brush, thus further facilitating the collection of the residual toners.

The magnetic polymerization toners will now be discussed.

Figure 18A:
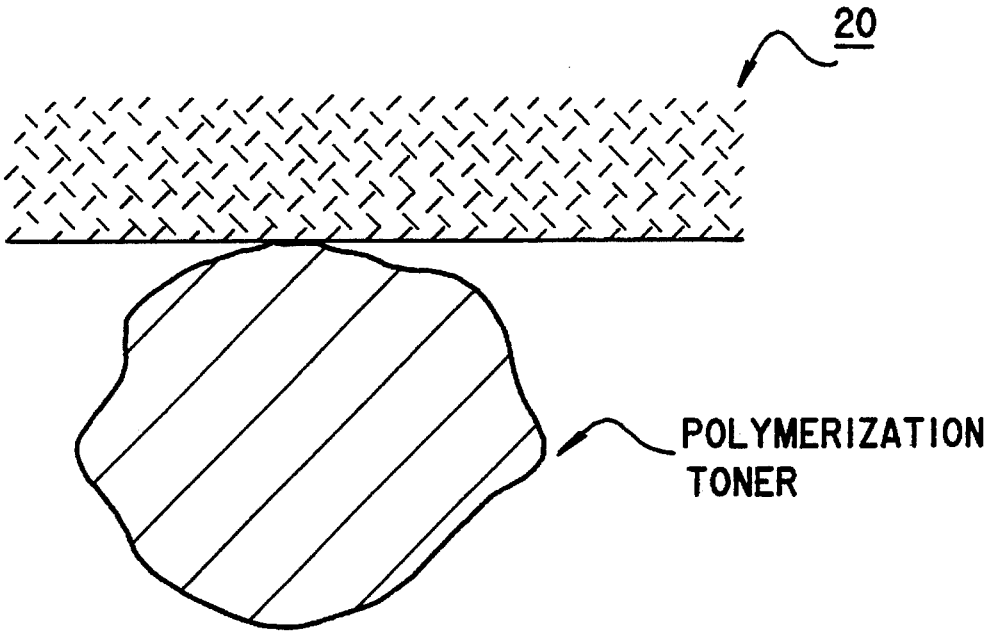
FIGS. 18A and 18B are model diagrams of magnetic polymerization toners.
Figure 18B:
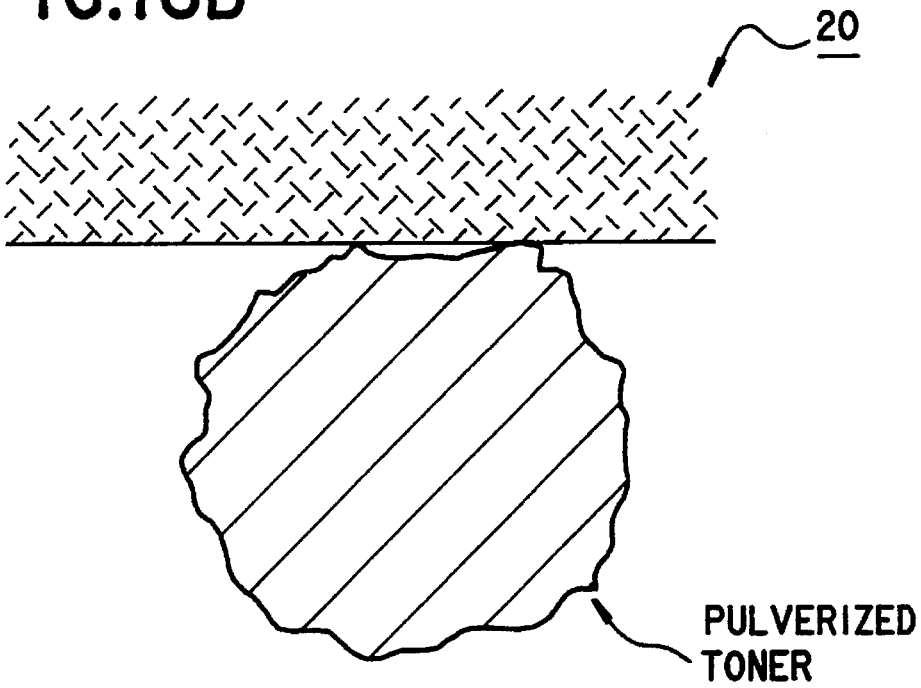
Figure 19A:
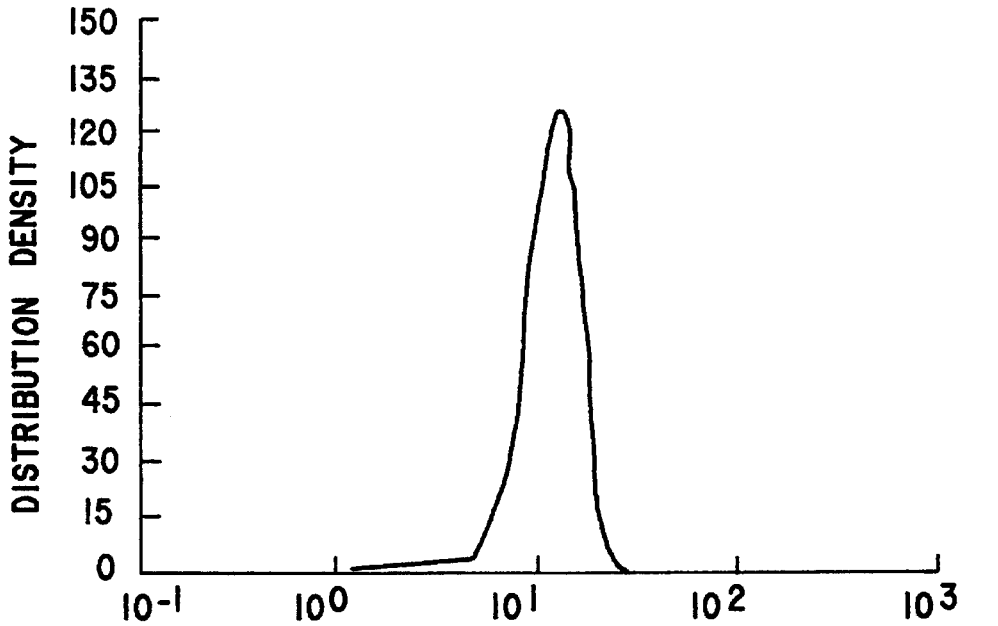
FIGS. 19A and 19B are diagrams showing the particle-size distribution of magnetic polymerization toners.
Figure 19B:
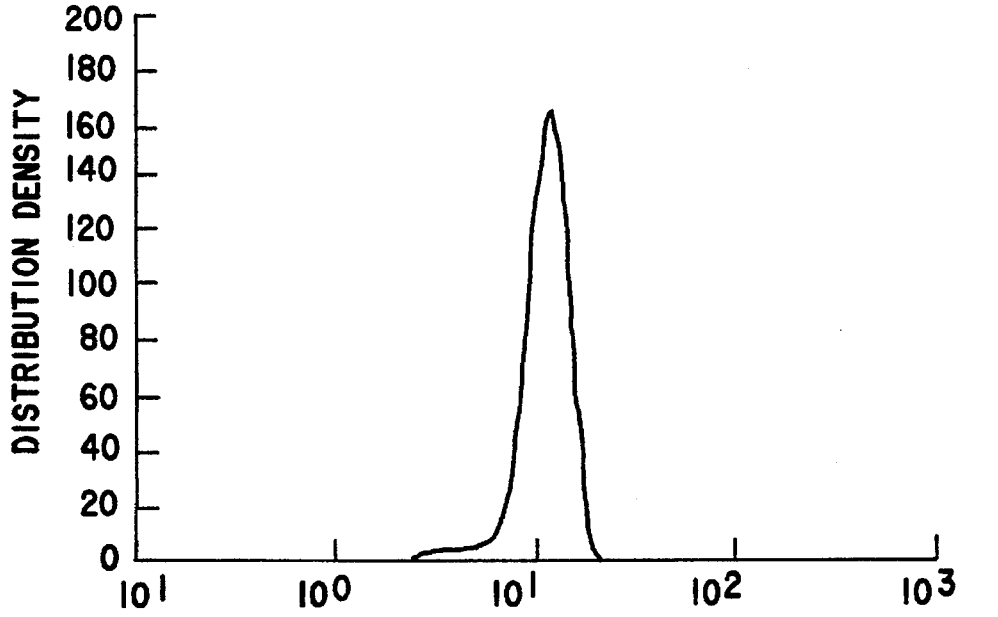
Figure 20A:
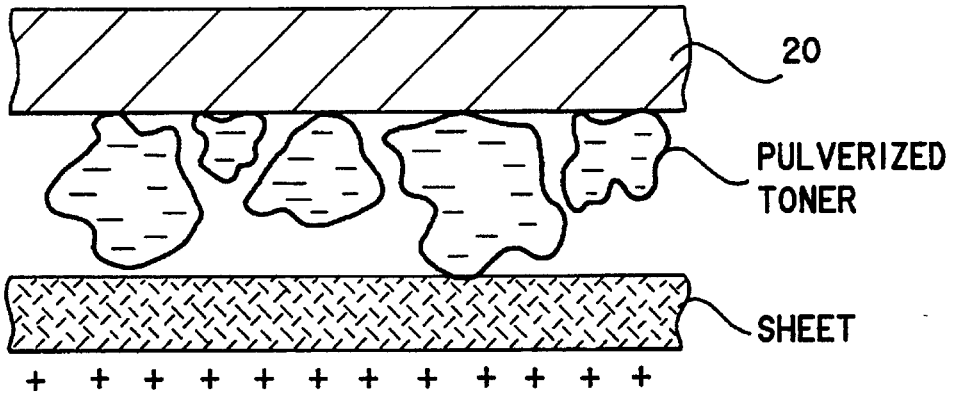
FIGS. 20A and 20B are toner-transfer model diagrams.
Figure 20B:
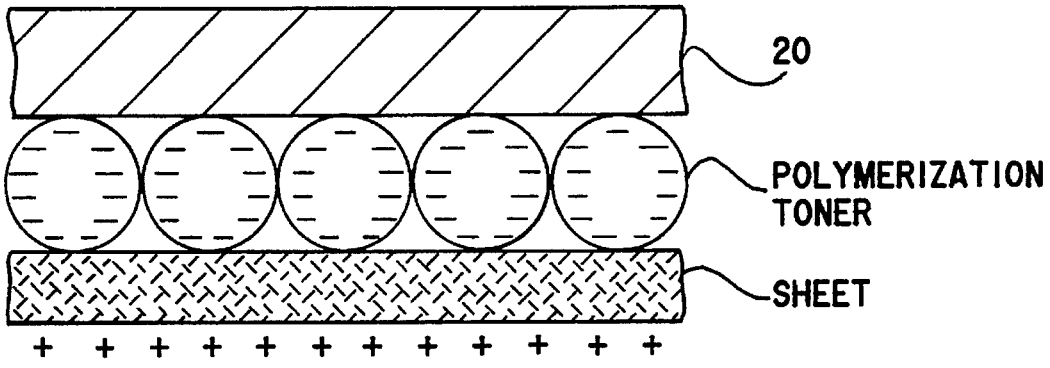
Figure 21:
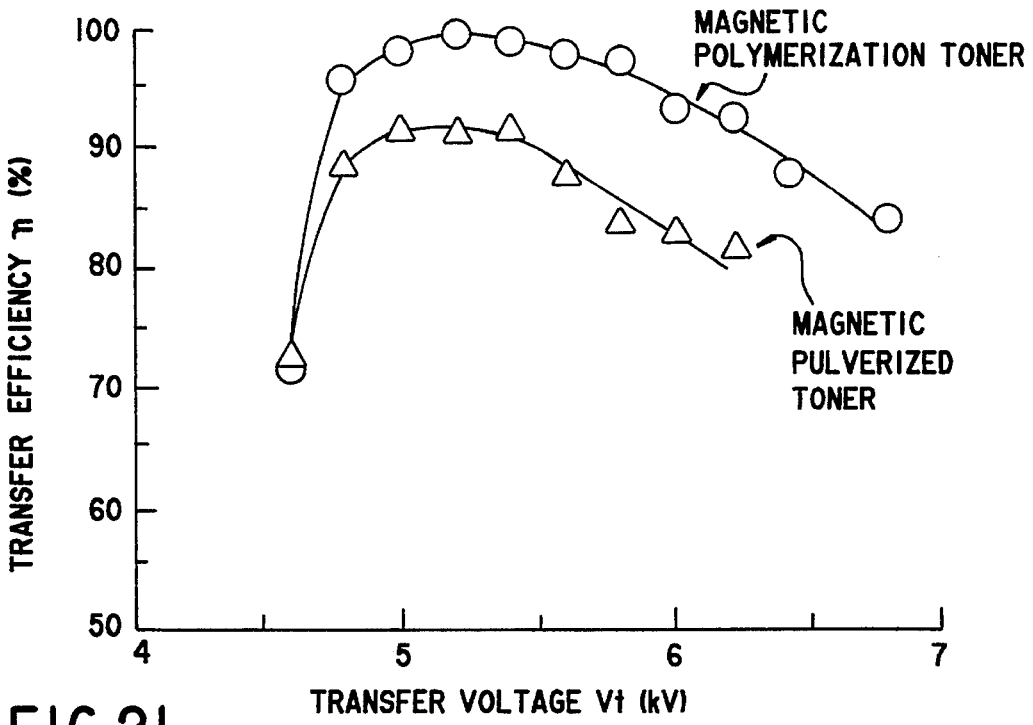
FIG. 21 is a transfer characteristic chart.
Figure 22:
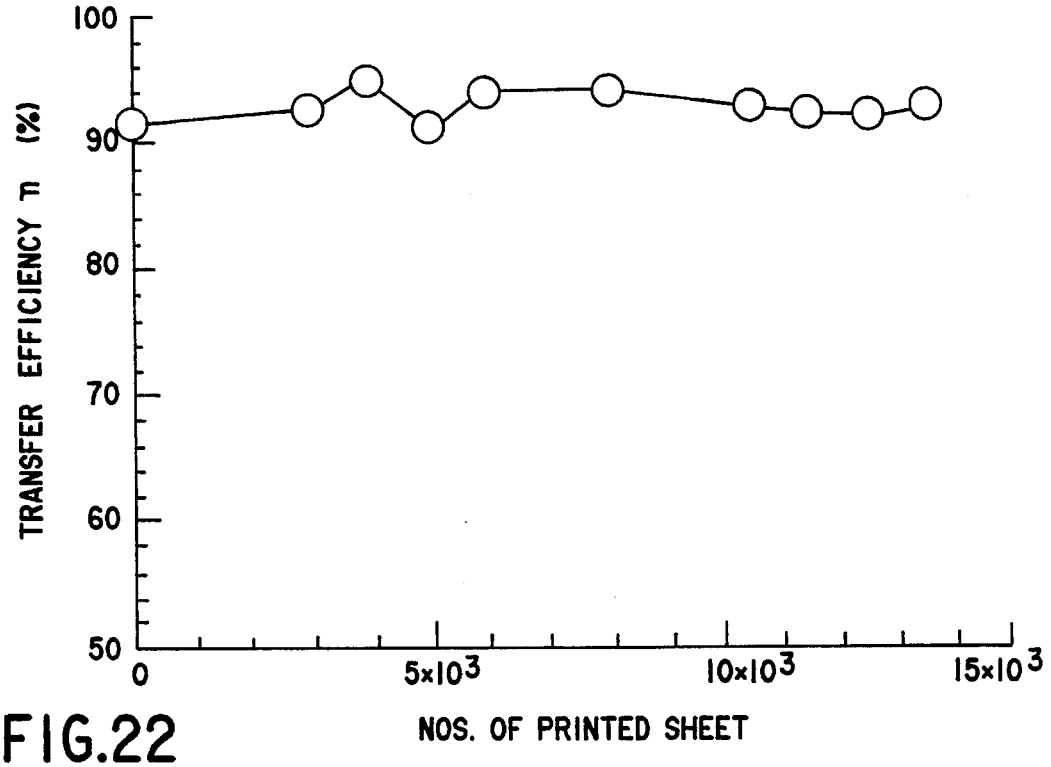
FIG. 22 is an explanatory diagram of the transfer efficiency.
Figure 23:
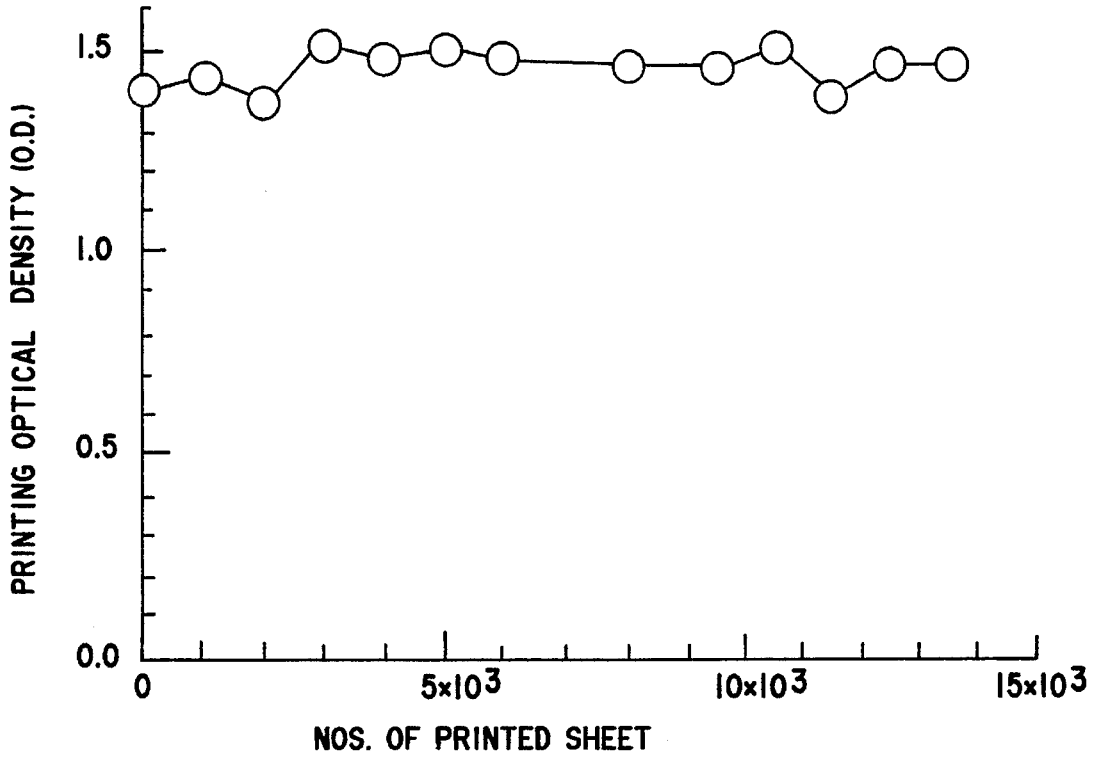
FIG. 23 is a characteristic chart of the printing density.

FIGS. 18A and 18B are model diagrams of magnetic polymerization toners according to the present invention, FIGS. 19A and 19B are diagrams showing the particle-size distribution of magnetic polymerization toners, FIGS. 20A and 20B are toner-transfer model diagrams, FIG. 21 is a transfer characteristic chart of the magnetic polymerization toners, FIG. 22 is an explanatory diagram of the transfer efficiency of the magnetic polymerization toners, and FIG. 23 is a characteristic chart of the printing density with the magnetic polymerization toners.

FIG. 21 is a characteristic chart which shows the transfer efficiency of the polymerization toners used in the present invention in comparison with the conventional pulverized toners. When the transfer voltage to the transfer charger is changed, the maximum transfer efficiency was 92% for the conventional pulverized toners as indicated by the triangle marks in the diagram. The maximum transfer efficiency for the magnetic polymerization toners of the present invention was high and was nearly 100%.

The following equation (3) was used as the evaluation index for the transfer efficiency.

$$\text{transfer efficiency} = \frac{(O.D.\text{ of transferred image})}{(O.D.\text{ of untransferred image}) + (O.D.\text{ of transferred image})} \times 100(\%) \quad (3)$$

The O.D. (Optical Density) of the transferred image was measured with the powder image, transferred on a sheet, secured thereon by a tape, while the O.D. of the untransferred image was measured with the untransferred toners, remaining on the photosensitive drum, secured by a tape thereon. It is to be noted that both the O.D. of the untransferred image and the O.D. of the transferred image are the densities from which the O.D. of a tape adhered to a white sheet of paper have already been subtracted as the background.

Analyzing the above, we understand that the mechanical adhesive strength of the polymerization toners is small. FIG. 18A shows how the magnetic polymerization toners stick on the photosensitive drum, and FIG. 18B shows how the conventional magnetic pulverized toners stick on the photosensitive drum. As shown in FIG. 18A, the polymerization toners have smooth surfaces and have a small mechanical adhesive strength (van der Waals force) to the photosensitive drum 20. It is therefore easier to transfer the toners on a sheet, and improvement on the transfer efficiency is expected.

The pulverized toners however have rough surfaces, so that the mechanical adhesive strength to the photosensitive drum 20 increases, lowering the transfer efficiency.

Secondly, the polymerization toners have a narrow particle-size distribution and have a uniform particle size. FIG. 19A shows the particle-size distribution of the pulverized toners, and FIG. 19B shows the particle-size distribution of the magnetic polymerization toners. The particle-size distribution of the pulverized toners is wide as apparent from FIG. 19A, whereas the particle-size distribution of the polymerization toners is narrow and sharp, which means that the toners have a uniform particle size, as apparent from FIG. 19B.

As the particle-size distribution of the pulverized toners is wide, gaps are easily formed between the toners and a sheet as shown in FIG. 20A which illustrates a toner-transfer model for the conventional pulverized toners. As a result, the transfer electric field is weakened and the transfer efficiency is reduced. As the particle-size distribution of the polymerization toners is narrow, however, gaps are not easily formed between the toners and a sheet as apparent from FIG. 20B which illustrates a toner-transfer model for the polymerization toners. As a result, the transfer electric field is effectively applied and the transfer efficiency is improved.

FIG. 22 shows a running characteristic when the transfer voltage and the initial value of the transfer efficiency in the characteristic in FIG. 21 are respectively set to 6 KV and 92%.

As shown in FIG. 22, the transfer efficiency for the magnetic polymerization toners of the present invention could be kept at the initial value of 92% or greater even for 15000 printouts. Further, the printing density for the magnetic polymerization toners could be kept at about 1.5 which is the initial value, even for 15000 printouts, as shown in FIG. 23.

The method of manufacturing the magnetic polymerization toners will now be described. The first method of manufacturing the magnetic polymerization toners includes a step of suspending and dispersing a polymerization monomer and magnetic powder or the like in water to yield monomer dews of about 5 to 20 μm (about the size of the desired toner particle size) which contain magnetic powder or the like, and then polymerizing the monomer dews. For example, the methods disclosed in Japanese Examined Patent Publication No. 10231/1961, Japanese Examined Patent Publication No. 14895/1976 and Japanese Unexamined Patent Publication No. 297855/1987 may be adapted for this purpose. While the magnetic toners obtained by the suspending polymerization method generally become close to balls, deformed balls after a post processing may also be used.

The second method of producing the magnetic toners includes a step of associating resin particles obtained by an emulsion polymerization method and magnetic powder or the like to yield particles of the desired size, and unifying the resin particles through anastomosis. This method is described in greater details in, for example, Japanese Unexamined Patent Publication No. 186253/1988 and Japanese Unexamined Patent Publication No. 282749/1988.

The first and second methods both can provide magnetic toners with a uniform particle size. Particularly, it is easy to control the toner shape from a deformed shape to a spherical shape in the second method, so that this second method will be discussed specifically below.

Figure 24:
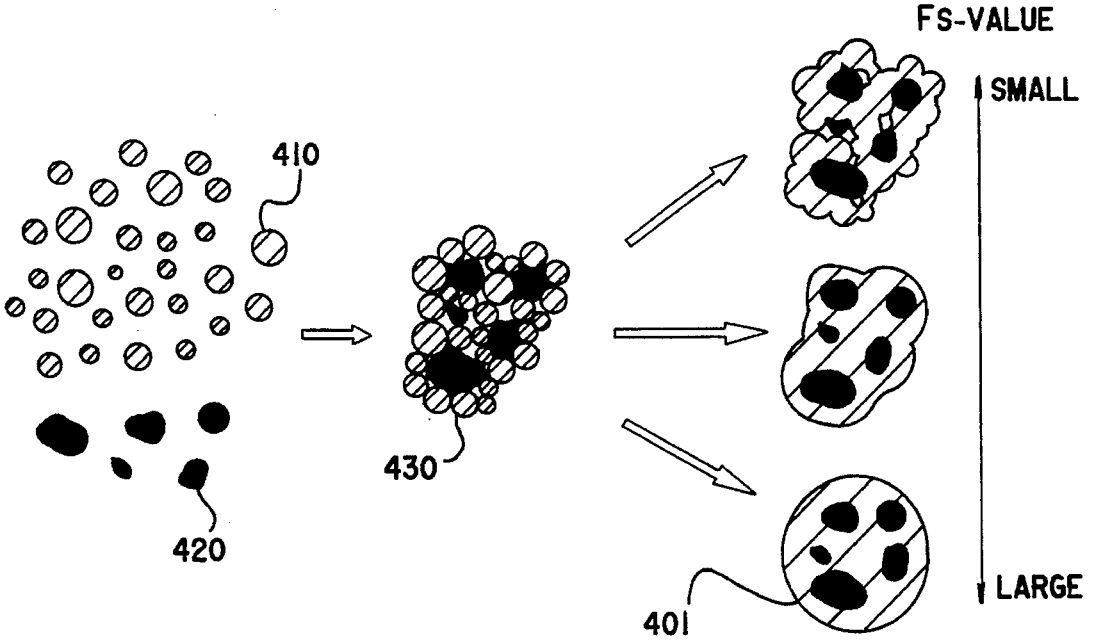
FIG. 24 is a diagram for explaining the process of producing the magnetic polymerization toners.
Figure 25:
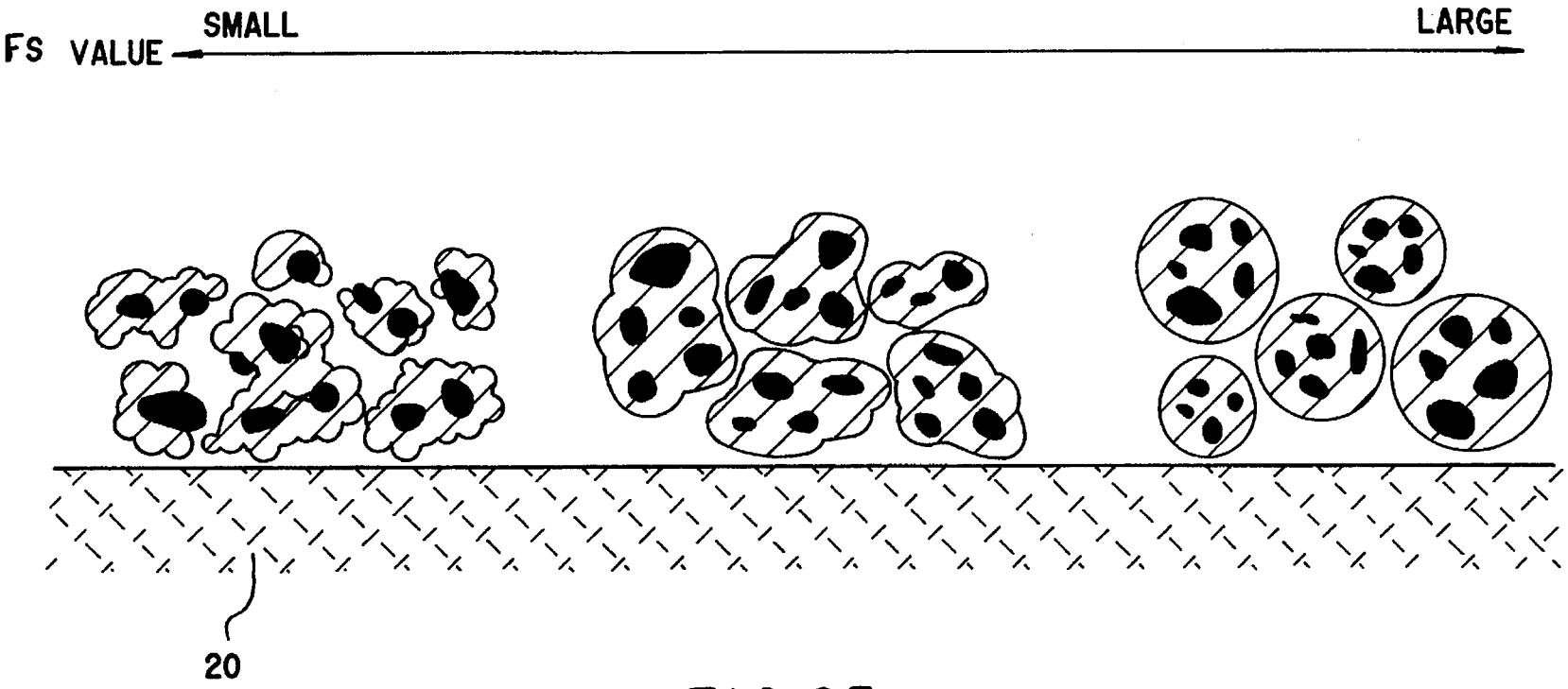
FIG. 25 is a diagram for explaining the specific surface area of the magnetic polymerization toners.
Figure 27A:
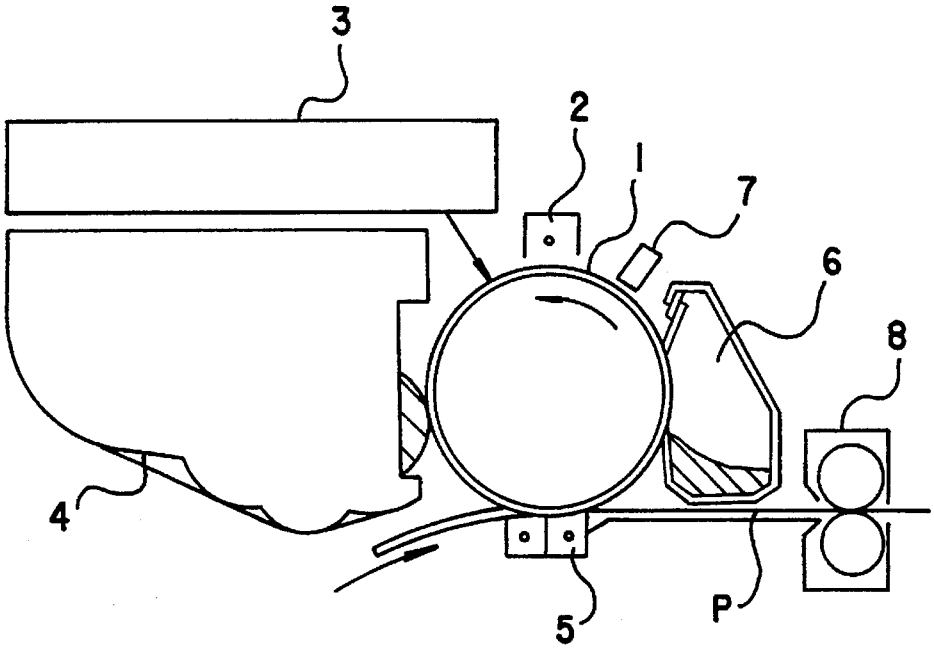
FIG.27A PRIOR ART
FIGS. 27A and 27B are explanatory diagrams of prior arts.
Figure 27B:
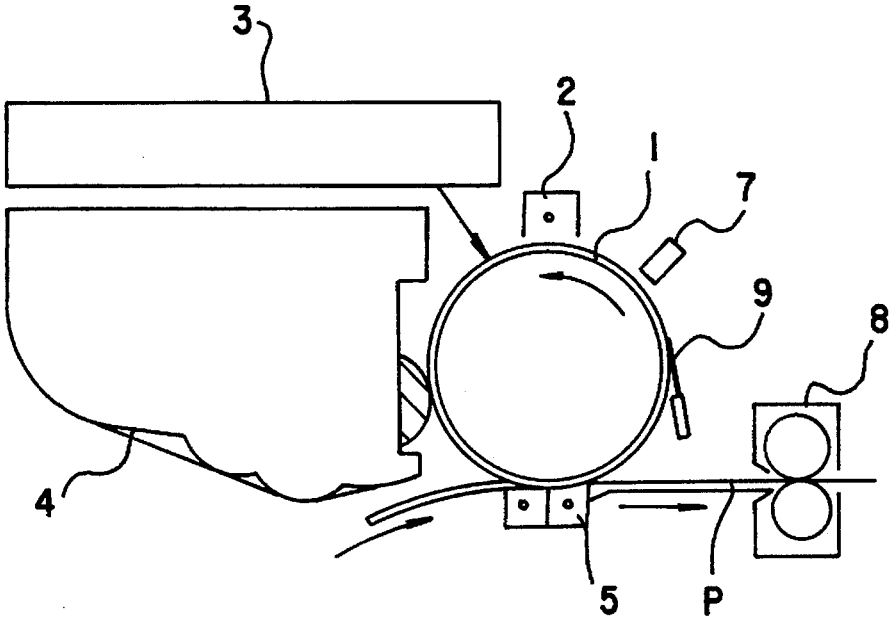
FIG.27B PRIOR ART
Figure 28:
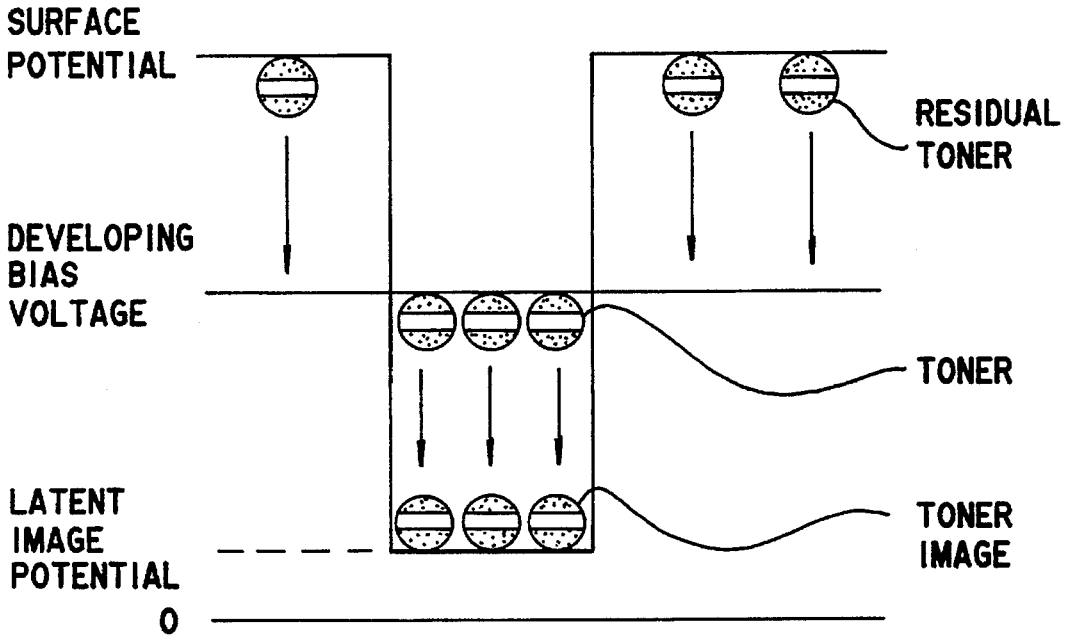
FIG.28 PRIOR ART
FIG. 28 is an explanatory diagram of the conventional cleanerless process.

FIG. 24 is a diagram for explaining the process of producing the magnetic polymerization toners, and FIG. 25 is a diagram for explaining the specific surface area of the magnetic polymerization toners.

First, primary resin particles having a particle size of 0.01 to 1 μm, preferably 0.05 to 0.5 μm, which contains an acidic polar group or basic polar group are prepared. Emulsion polymerization or soap-free emulsion polymerization is a suitable method to prepare the resin particles. The following will discuss the emulsion polymerization. In this case, a monomer mixture is added to water to which a polymerization initiator and emulsifier are added, and is dispersed and emulsified by a disperser, an ultrasonic homogenizer or the like.

Next, the resultant product is heated for radical polymerization while being stirred, yielding emulsion 410. After magnetic powder 420 and an additive, such as a dye, carbon or wax, when necessary to color, control charges, prevent an offset at the time of image fixing, are added to the emulsion 410 and are associated with each other, as shown in FIG. 24. In some case, the primary particles or the like may be grown to secondary particles so that an associated product 430 of the secondary particles can be prepared.

Further, the resultant product is heated while being stirred for anastomosis (aging) of the particles, and the product is filtered, cleaned and then dried to prepare dry toners 401. The particle size of the finally obtained magnetic toners was measured with a coal-tar counter (manufactured by Coal Tar Electronics Co., Ltd.). The volume average particle size of the magnetic toners is 3 to 25 μm, preferably 5 to 12 μm, and most preferably 7 to 10 μm. For the purpose of reforming the fluid, know particles of hydrophobic silica, titanius oxide or the like may be added by an amount of about 0.1 to 5% by weight, preferably 0.3 to 2% by weight.

The controllable range is when the ratio (Fs) of the specific surface area that is computed for uniform true balls to the specific surface area (S) that is measured by the BET method, as the evaluation index for the shape of the toners, is in a range from 0.2 to 0.9. The value of Fs will be given by the following equation (4).

$$Fs=6/\rho \cdot d \cdot S \quad (4)$$

where ρ is the specific weight of the toners and d is the volume average particle size.

When the specific surface area measured by the BET method using a gas mixture containing 70% of helium and 30% of nitrogen, the volume average particle size measured by the coal-tar counter, and the specific weight of the toners, calculated from the specific weights of resin and magnetic powder respectively of 1.1 g/cm$^3$ and 5 g/cm$^3$, were used, Fs of the typical magnetic polymerization toners was 0.3 to 0.6. The polymerization toners apparently have a relatively deformed shape and their sphericity is not so different from that of the conventional pulverized toners. But, the tensile strength of the pulverized toners measured by a powder tester was about 3 g/cm$^2$, about two times the tensile strength of the typical polymerization toners which was about 1.6 g/cm$^2$.

From this, it is apparent that the smoothness of the toner surface greatly influences the adhesive force of the toners, and why the polymerization toners have a high transfer efficiency. A preferable value for Fs is 0.3 to 0.5. It is also preferable that the polymerization toners should have a tensile strength of 2 g/cm$^2$ or below.

The polymerization monomer mixture used here consist of an essential monomer, and a monomer having an acidic polar group or basic polar group. A preferable example of the essential monomer is a mixture of a styrene monomer and alkylesteracrylate or alkylestermethacrylate. The essential monomer is not however limited to this particular type.

As the styrene monomer, for example, syren, o-methylstyrene, m-methylstyrene, p-methylstyrene, p-methoxystyrene, p-phenylstyrene, p-chlorstyrene, 3,4-dichlorostyrene, p-ethylstyrene, 2,4-dimethylstyrene, p-n-butylstyrene, p-tert-butylstyrene, p-n-nonylstyrene, p-n-octylstyrene, p-n-hexylstyrene, and p-n-dodecylstyrene may be used.

As the alkylesteracrylate or alkylestermethacrylate, for example, methylacrylate, ethylacrylate, n-butylacrylate, isobutylacrylate, propylacrylate, n-octylacryalte, dodecylacrylate, laurylacrylate, 2-ethylexylacrylate, stearylacrylate, and 2-chloroetylacrylate, or methylmethacrylate, etylmethacrylate, propylmethacrylate, n-butylmethacrylate, isobutylmethacrylate, n-octylmethacrylate dodecylmethacrylate, laurylmethacrylate, 2-ethylhexylmethacrylate, stearylmethacrylate, phenylmethacrylate, and dimethyl-aminoetylmethacrylate may be used singularly or in mixture.

Further, an ethylene unsaturated monoolefin group, such as ethylene, propylene, butylene or isobutylene, a vynyl halide group, such as vinyl chloride, vinylidene chloride, vinyl bromide or vinyl fluoride, an organic acid vinyl ester group, such as vinyl acetate, vinyl propionate or vinyl benzonate, a vinyl ether group, such as vinylmethyl ether, vinylethyl ether or vinylisobutyl ether, a vinyl keton group, such as vinyl methylketon, vinylhexylketon or methylisopropynylketon, a n-vinyl compound, such as n-vynylpyrole, n-vinyl indole or n-vinyl pryrrolidone, a vinylnaphthalene group, and a polymerization monomer, such as acrylonitrile, methacrylonitrile or acrylamide, may also be used.

As the monomer having an acidic polar group, an α, β-etylene saturated compound having a carboxyl group or sulfonic group may be used. The compound includes acrylic acid, methacrylic acid, fumaric acid, maleic acid, itaconic acid, cinnamic acid, monobutylester maleate, monooctylester maleate, styrene sulfonate, allylsulfo succinate, allylsulfo-octyl succinate, or their metal salts.

As the monomer having a basic polar group, ester acrylate or ester methacrylate of aliphatic alcohol having an amine group or 4-ammonium group is suitable. For example, dimethylaminoetyl acrylate, dimethylaminoetyl methacrylate, diethylaminoetyl acrylate, diethylaminoetyl methacrylate, and their 4-ammonium salts may be used.

Also usable are amide acrylate or amide methacrylate, such as acrylamide, n-butylacrylamide, n,n-dimethylacrylami de, methacrylamide, n-butymethacrylamide, n,n-dimethylmethacrylamide, or n-octadecylacrylamide, a vinyl compound substituted with heterocyclic group having n as a ring, such as vinyl pyridine, vinyl pyrrolidone, vinyl n-methylpyridinium chloride, or vinyl n-ethylpyridinium chloride, and n,n-dialylalkylamine, such as n,n-dialylmethylammonium chloride, or n,n-dialylethylammonium chloride.

As the emulsifier, known types of emulsifiers may be used. Such emulsifiers include an anionic emulsifier, such as higher alcohol sulfate ester, alylbenzen sodium sulfonate, or fatty acid sodium, a cationic emulsifier, such as an adduct of alkylphenoletyleneoxide or an adduct of higher alcohol ethyleneoxide, and a cationic emulsifier such as 4-ammonium salt. The amount of the emulsifier is 0.01 to 1% by weight, preferably 0.1 to 0.5% by weight with respect to water.

As the polymerization initiator, know water-soluble polymerization initiators, such as persulfate like potassium persulfate or ammonium persulfate, and hydrogen peroxide may be used. The amount of the polymerization initiator is 0.01 to 10% by weight of the polymerization mixture, more preferably 0.05 to 5% by weight.

The magnetic powder may be of a known type like magnetite powder, ferrite powder or iron powder. Particularly, magnetite powder with an average particle size of 0.1 to 1 μm is preferable. The amount of the magnetic powder content is 10 to 60% by weight, preferably 30 to 50% by weight.

Specific examples of the present invention will now be discussed, and it should be noted that the present invention is in no way limited to those examples.

EXAMPLES 1 TO 9

After 80 parts by weight of styrene, 20 parts by weight of butylacrylate and 5 parts by weight of acrylic acid were sufficiently stirred and mixed, the mixture was dipped in 100 parts by weight of distilled water added with 2 parts by weight of an emulsifier and 0.5 part by weight of a polymerization initiator, and was polymerized while being stirred at 70° C., preparing an emulsion containing particles with a particle size of about 0.2 μm.

Next, 50 parts by weight of the obtained emulsion as a solid matter, 50 parts by weight of magnetite powder (particle size of about 0.5 μm) and 3 parts by weight of polypropylene resin (viscol 550P, produced by Sanyo Chemical Industries, Ltd.) were stirred in 400 parts by weight of distilled water. After the resultant product was kept at 60 to 90° C. for 2 to 10 hours while being dispersed and stirred, the resultant product after cooling was filtered, cleaned and dried, preparing magnetic polymerization toners with different particle sizes and Fs values.

FIG. 26 shows the volume average particle size and Fs of the prepared toners.

Further, 1% by weight of hydophobic silica (H-2000, produced by Hoechst Limited) was added as a fluid reforming agent to yield magnetic toners of Examples 1 to 9.

Comparative Example 1

With the heating and stirring conditions for Examples 1 to 9 was changed to 70 μm and one hour, magnetic polymerization toners with a volume average particle size of about 7 μm and Fs of about 0.2 was prepared. As in the Examples, hydrophobic silica was added to the magnetic polymerization toners to obtain magnetic toners of Comparative Example 1.

Comparative Example 2

After 50 parts by weight of the styrene-butylacrylate resin (8:2), 50 parts by weight of magnetite powder and 3 parts by weight of polypropylene resin (viscol 550P, produced by Sanyo Chemical Industries, Ltd.) were mixed, and melted and kneaded by a two-shaft continuous extruder. The obtained resin was roughly pulverized by a rotoplex, then finely pulverized by a jet mill, and then classified by a wind-powered classifier, preparing magnetic toners with an average particle size of 10 μm. As in the Examples, hydrophobic silica was added to the magnetic polymerization toners to obtain magnetic pulverized toners of Comparative Example 1.

The magnetic toners of Examples 1 to 9 and those of Comparative Examples 1 and 2 were combined with non-coat ferrite carriers with an average particle size of 60 μm at a toner density of about 20%, and the printing characteristic and transfer efficiency of the corona transfer unit were studied using the cleanerless type electrophotographing printer shown in FIG. 2.

The printing conditions, such as the developing bias, were adjusted for each type of magnetic toners to ensure sufficient image density. The optimal developing conditions differed depending of the toner types. The reason may be because that due to the difference in the toner shape and particle size, the charging characteristic and the scraping force of the magnetic brush slightly differ.

As shown in FIG. 26, good image densities (O.D.) could obtained with the magnetic toners of Examples 1–9 and the magnetic toners of Comparative Example 2, while the particles of the magnetic toners of Comparative Example 1 were pulverized so that a high-quality printout could not be obtained. This might have occurred because the aging of resin particles was insufficient so that the particles could not stand the mechanical stress applied by the experimenting equipment. Further, background noise was observed only with the use of the magnetic pulverized toners of Comparative Example 2. The magnetic toners of present Examples showed the tendency that as Fs becomes smaller or the volume average particle size becomes smaller, a higher image density is obtained with a lower developing bias.

Next, the untransferred toners (powder image) on the photosensitive drum were removed with a tape, and the transfer efficiencies were calculated from the optical densities (O.D.) of the image portions using the equation (3), and were compared with one another. The results are shown in FIG. 26.

It is apparent from FIG. 26 that the transfer efficiencies of the magnetic polymerization toners of Examples 2 to 4 and 7 to 9 were high, ranging from 98 to 99%. A substantial amount of untransferred toners was observed for the magnetic pulverized toners of Comparative Example 2, with the transfer efficiency of 90% or below. This may be the cause of the background noise.

For the magnetic toners of Example 1 having small Fs and the magnetic toners of Examples 5 and 6 having a small particle size, the transfer efficiencies became about 95%, slightly lower than those of the other Examples. This may have occurred due to the mechanical adhesive strength increased by the increasing contact points, as shown in FIG. 25. It should however be noted that the transfer efficiencies are still higher than that of the magnetic toners of Comparative Example 2, so that the use of Examples 1, 5 and 6 in the cleanerless electrophotographing process would be still advantageous as long as the value of Fs lies between 0.3 to 0.8 and the volume average particle size lies in a range of 5 to 12 μm.

From the above, the magnetic polymerization toners of the present invention show an excellent transfer efficiency with respect to the transfer means that uses electrostatic force so that cleaning means can be omitted accordingly. The value of Fs should preferably be 0.3 or above, and the volume average particle size should preferably be 6 μm or greater. Further, the most preferable Fs would be about 0.3 to 0.5 and the most preferable volume average particle size would be 7 to 10 μm in consideration of the printing characteristics, such as the developability and resolution.

According to the present invention, magnetic polymerization toners were used as magnetic toners. As the magnetic polymerization toners have smooth surfaces, have a lower mechanical adhesive strength to the photosensitive drum 20 and have a uniform particle size, less gaps would be formed between a transfer sheet and the photosensitive drum 20 and the transfer electric field can be applied effectively. The transfer efficiency is therefore improved and the amount of residual toners is reduced, thus facilitating the collection of the residual toners in the developing process.

As associated particles containing resin particles, prepared as an essential substance by emulsion polymerization, and magnetic powder, are used for magnetic polymerization toners, the resultant polymerization toners will have a surface shape that ensures a good transfer efficiency. Since the resin particles cover the magnetic powder so that the low-resistant magnetic powder is not exposed, the transfer electric field can be applied effectively to the magnetic toners, thus further improving the transfer efficiency.

The present invention may be modified in various manners as follows.

First, although a 1.5-component developer having a combination of the magnetic carrier and magnetic toners is used as a developer in the above-described embodiment, the magnetic toners alone may be used as the developer. Secondly, although only the sleeves of the developing roller 24 are rotated, the magnet roller may also be rotated. Thirdly, although the LED optical system has been explained as an image exposing section, a laser optical system, a liquid crystal shutter optical system, an EL (electroluminescent) optical system and so forth may be used as well. Fourthly, although the image forming mechanism has been explained as an electrophotographying mechanism in the foregoing description of the embodiment, another image forming mechanism (like an electrostatic recording mechanism) which transfers a toner image on a sheet may also be used, and sheets are not limited to paper but other types of media can be used as well. Further, the photosensitive body is not limited to a drum type, but may be of an endless belt type. Fifthly, although the present invention has been explained as a printing apparatus, it may be a different type of image forming apparatus, such as a copying machine or facsimile. Sixthly, although the present invention has been explained as an electrophotograp hic printer which can be placed in an upright position as well as a horizontal position, this invention may be adapted for use in an electrophotographic printer which can be placed in either a horizontal position or an upright position.

The present invention is not limited to the above-described embodiment, but may be modified in various forms without departing from the spirit and scope of the invention. Therefore, the present examples and embodiment are to be considered as illustrative and not restrictive and the invention is not to be limited to the details given herein, but may be modified within the scope of the appended claims.

In short, according to the present invention, as the residual toners are collected in the cleanerless process using the magnetic force and scraping force as well as the electrostatic force, the efficiency of collecting the residual toners in the developing process will be improved to prevent an afterimage from being formed in the cleanerless process. Further, uncharged toners and toners charged to the opposite polarity will not stick on the photosensitive drum in the developing process, which further contributes to preventing the formation of an afterimage.

What is claimed is:

1. An image forming method for forming an image on a sheet, comprising the steps of:

forming an electrostatic latent image on a rotary endless latent image carrier;

forming a magnetic brush with a developer, comprising magnetic toners and magnetic carriers, in a developing area, for developing the electrostatic latent image on said latent image carrier, and thereby for collecting residual toners on said latent image carrier, a toner density of the developer in the formed magnetic brush being set to near a limiting toner density; and transferring said developed image on said latent image carrier to a sheet.

2. The image forming method according to claim 1, wherein said magnetic toners includes magnetic polymerization toners.

3. The image forming method according to claim 2, wherein said magnetic polymerization toners are associated particles containing resin particles, prepared as an essential substance by emulsion polymerization, and magnetic powder.

4. The image forming method according to claim 3, wherein said magnetic polymerization toners are prepared by aging a part of at least said resin particles in said associated particles.

5. The image forming method according to claim 2, wherein said magnetic polymerization toners have a volume average particle size d, a density ρ and a specific surface area S in such a relation that $6/\rho \cdot d \cdot S$ lies in a range of 0.3 to 0.8 and d is between 5 to 12 μm.

6. An image forming method for forming an image on a sheet, comprising the steps of:

forming an electrostatic latent image on a rotary endless latent image carrier;

forming a magnetic brush with a developer, comprising magnetic toners and magnetic carriers, in a developing area, for developing the electrostatic latent image on said latent image carrier, and thereby for collecting residual toners on said latent image carrier, a toner density of the developer in the formed magnetic brush being set lower than a limiting toner density; and transferring said developed image on said latent image carrier to a sheet.

7. The image forming method according to claim 6, wherein said magnetic toners includes magnetic polymerization toners.

8. The image forming method according to claim 7, wherein said magnetic polymerization toners are associated particles containing resin particles, prepared as an essential substance by emulsion polymerization, and magnetic powder.

9. The image forming method according to claim 8, wherein said magnetic polymerization toners are prepared by aging a part of at least said resin particles in said associated particles.

10. The image forming method according to claim 7, wherein said magnetic polymerization toners have a volume average particle size d, a density ρ and a specific surface area S in such a relation that $6/\rho \cdot d \cdot S$ lies in a range of 0.3 to 0.8 and d is between 5 to 12 μm.

11. An image forming method for forming an image on a sheet, comprising the steps of:

forming an electrostatic latent image on a rotary endless latent image carrier;

forming a magnetic brush with a developer, comprising magnetic polymerization toners and magnetic carriers, in a developing area, for developing the electrostatic latent image on said latent image carrier, and thereby for collecting residual toners on said latent image carrier; and transferring said developed image on said latent image carrier to a sheet.

12. The image forming method according to claim 11, wherein said magnetic polymerization toners used in said magnetic brush forming step are associated particles containing resin particles, prepared as an essential substance by emulsion polymerization, and magnetic power.

13. The image forming method according to claim 12, wherein said magnetic polymerization toners are prepared by aging a part of at least said resin particles in said associated particles.

14. The image forming method according to claim 12, wherein said magnetic polymerization toners have a volume average particle size d, a density ρ and a specific surface area S in such a relation that $6/\rho \cdot d \cdot S$ lies in a range of 0.3 to 0.8 and d is between 5 to 12 μm.

15. An image forming method for forming an image on a sheet, comprising the steps of:

forming an electrostatic latent image on a rotary endless latent image carrier;

forming a magnetic brush with a developer, comprising magnetic toners and magnetic carriers, by developer supplying means including a magnetic field generating member having a plurality of magnetic poles, provided in a rotatable sleeve, in a developing area, for developing the electrostatic latent image on said latent image carrier, and thereby for collecting residual toners on said latent image carrier, a toner density of the developer in the formed magnetic brush being set to near a limiting toner density; and transferring said developed image on said latent image carrier to a sheet.

16. An image forming method for forming an image on a sheet, comprising the steps of:

forming an electrostatic latent image on rotary endless latent image carrier;

forming a magnetic brush with a developer, comprising magnetic toners and magnetic carriers, by developer supplying means including a magnetic field generating member having a plurality of magnetic poles, provided in a rotatable sleeve, in a developing area, for developing the electrostatic latent image on said latent image carrier, and thereby for collecting residual toners on said latent image carrier, a toner density of the developer in the formed magnetic brush being set lower than a limiting toner density; and transferring said developed image on said latent image carrier to a sheet.

17. An image forming method for forming an image on a sheet, comprising the steps of:

forming an electrostatic latent image on a rotary endless latent image carrier;

forming a magnetic brush with a developer, comprising magnetic polymerization toners and magnetic carriers, by developer supplying means including a magnetic field generating member having a plurality of magnetic poles, provided in a rotatable sleeve, in a developing area, for developing the electrostatic latent image on said latent image carrier, and thereby for collecting residual toners on said latent image carrier; and transferring said developed image on said latent image carrier to a sheet.

18. The image forming method according to claim 17, wherein said magnetic polymerization toners used in said magnetic brush forming step are associated particles containing resin particles, prepared as an essential substance by emulsion polymerization, and magnetic powder.

19. The image forming method according to claim 18, wherein said magnetic polymerization toners are prepared by aging a part of at least said resin particles in said associated particles.

20. The image forming method according to claim 17, wherein said magnetic polymerization toners have a volume average particle size d, a density ρ and a specific surface area S in such a relation that $6/\rho \cdot d \cdot S$ lies in a range of 0.3 to 0.8 and d is between 5 to 12 μm.

21. An image forming apparatus for forming an image on a sheet, comprising:

a rotary endless latent image carrier;

image forming means for forming an electrostatic latent image on said latent image carrier;

developing means including a developing room, and a rotatable sleeve and a fixed magnetic roller provided in the sleeve and having a plurality of magnetic poles in a circumferential direction of the fixed magnetic roller in the developing room, said developing means forming a magnetic brush with a developer comprising magnetic toners and magnetic carriers in the developing room, for developing the electrostatic latent image on said latent image carrier, and for collecting residual toners on said latent image carrier, a toner density of the developer in the developing room being set to near a limiting toner density; and transfer means for transferring said developed image on said latent image carrier to a sheet.

22. The image forming apparatus according to claim 21, wherein said developing room retains magnetic carriers by which said toner density becomes near said limiting toner density with respect to a developer retaining volume of said developing room.

23. The image forming apparatus according to claim 21, further comprising distribution means, provided between said transfer means and said image forming means, for distributing residual toners on said latent image carrier.

24. An image forming apparatus for forming an image on a sheet, comprising:

a rotary endless latent image carrier;

image forming means for forming an electrostatic latent image on said latent image carrier;

developing means including a developing room, and a rotatable sleeve and a fixed magnetic roller provided in the sleeve and having a plurality of magnetic poles in a circumferential direction of the fixed magnetic roller in the developing room, said developing means forming a magnetic brush with a developer comprising magnetic toners and magnetic carriers in the developing room, for developing the electrostatic latent image on said latent image carrier, and for collecting residual toners on said latent image carrier, a toner density of the developer in the developing room being set lower than a limiting toner density; and transfer means for transferring said developed image on said latent image carrier to a sheet.

25. The image forming apparatus according to claim 24, further comprising distribution means, provided between said transfer means and said image forming means, for distributing residual toners on said latent image carrier.

26. An image forming apparatus for forming an image on a sheet, comprising:

a rotary endless latent image carrier;

image forming means for forming an electrostatic latent image on said latent image carrier;

developing means for forming a magnetic brush with a developer comprising magnetic polymerization toners and magnetic carriers in a developing room, for developing the electrostatic latent image on said latent image carrier, and for collection of residual toners on said latent image carrier; and transfer means for transferring said developed image on said latent image carrier to a sheet.

27. The image forming apparatus according to claim 26, wherein said magnetic polymerization toners are associated particles containing resin particles, prepared as an essential substance by emulsion polymerization, and magnetic powder.

28. The image forming apparatus according to claim 27, wherein said magnetic polymerization toners are prepared by aging a part of at least said resin particles in said associated particles.

29. The image forming apparatus according to claim 27, wherein said magnetic polymerization toners have a volume average particle size d, a density $\rho$ and a specific surface area S in such a relation that $6/\rho \cdot d \cdot S$ lies in a range of 0.3 to 0.8 and d is between 5 to 12 μm.

30. The image forming apparatus according to claim 26, further comprising distribution means, provided between said transfer means and said image forming means, for distributing residual toners on said latent image carrier.

31. An image forming apparatus for forming an image on a sheet, comprising:

a rotary endless latent image carrier;

image forming means for forming an electrostatic latent image on said latent image carrier;

developing means including a developing room for retaining a developer comprising magnetic toners and magnetic carriers, a toner supplying room for retaining magnetic toners to be supplied to the developing room, and magnetic brush forming means having a rotatable sleeve and a fixed magnetic roller provided in the sleeve and having a plurality of magnetic poles in a circumferential direction of the fixed magnetic roller in the developing room, said developing means forming a magnetic brush with a developer in the developing room, for developing the electrostatic latent image on said latent image carrier, and for collecting residual toners on said latent image carrier, a toner density of the developer in the developing room being set to near a limiting toner density; and transfer means for transferring said developed image on said latent image carrier to a sheet.

32. The image forming apparatus according to claim 31, wherein said developing room retains magnetic carriers by which said toner density becomes near said limiting toner density with respect to a developer retaining volume of said developing room.

33. The image forming apparatus according to claim 31, further comprising distribution means, provided between said transfer means and said image forming means, for distributing residual toners on said latent image carrier.

34. The image forming apparatus according to claim 31, further comprising partitioning means for partitioning said developing room and said toner supplying room to prevent moving the magnetic carriers from said developing room to said toner supplying room.

35. An image forming apparatus for forming an image on a sheet, comprising:

a rotary endless latent image carrier;

image forming means for forming an electrostatic latent image on said latent image carrier;

developing means including a developing room for retaining a developer comprising magnetic toners and magnetic carriers, a toner supplying room for retaining magnetic toners to be supplied to the developing room, and magnetic brush forming means having a rotatable sleeve and a fixed magnetic roller provided in the sleeve having a plurality of magnetic poles in a circumferential direction of the fixed magnetic roller in the developing room, said developing means forming a magnetic brush with a developer in the developing room, for developing the electrostatic latent image on said latent image carrier, and for collection of residual toners on said latent image carrier, a toner density of the developer in the developing room being set lower than a limiting toner density; and transfer means for transferring said developed image on said latent image carrier to a sheet.

36. The image forming apparatus according to claim 35, further comprising distribution means, provided between said transfer means and said image forming means, for distributing residual toners on said latent image carrier.

37. The image forming apparatus according to claim 35, further comprising partitioning means for partitioning said developing room and said toner supplying room to prevent moving the magnetic carriers from said developing room to said toner supplying room.

38. An image forming apparatus for forming an image on a sheet, comprising:

a rotary endless latent image carrier;

image forming means for forming an electrostatic latent image on said latent image carrier;

developing means including a developing room for retaining a developer comprising magnetic polymerization toners and magnetic carriers, and a toner supplying room for retaining the magnetic polymerization toners to be supplied to the developing room, said developing means forming a magnetic brush with a developer in the developing room, for developing the electrostatic latent image on said latent image carrier, and for collecting residual toners on said latent image carrier; and transfer means for transferring said developed image on said latent image carrier to a sheet.

39. The image forming apparatus according to claim 38, wherein said magnetic polymerization toners are associated particles containing resin particles, prepared as an essential substance by emulsion polymerization, and magnetic powder.

40. The image forming apparatus according to claim 39, wherein said magnetic polymerization toners are prepared by aging a part of at least said resin particles in said associated particles.

41. The image forming apparatus according to claim 39, wherein said magnetic polymerization toners have a volume average particle size d, a density ρ and a specific surface area S in such a relation that $6/\rho \cdot d \cdot S$ lies in a range of 0.3 to 0.8 and d is between 5 to 12 μm.

42. The image forming apparatus according to claim 38, further comprising distribution means, provided between said transfer means and said image forming means, for distributing residual toners on said latent image carrier.

43. The image forming apparatus according to claim 38, further comprising partitioning means for partitioning said developing room and said toner supplying room to prevent moving the magnetic carriers from said developing room to said toner supplying room.

44. An image forming apparatus for forming an image on a sheet, comprising:

a rotary endless latent image carrier;

image forming means for forming an electrostatic latent image on said latent image carrier;

developing means including a developing room retaining a developer comprising magnetic polymerization toners and magnetic carriers, and a developer supplying means including a rotatable sleeve and a magnetic field generating member provided in the sleeve and having a plurality of magnetic poles in a circumferential direction of the rotatable sleeve, said developing means forming a magnetic brush with a developer in the developing room, for developing the electrostatic latent image on said latent image carrier, and for collecting residual toners on said latent image carrier; and transfer means for transferring said developed image on said latent image carrier to a sheet.

45. The image forming apparatus according to claim 44, wherein said magnetic polymerization toners are associated particles containing resin particles, prepared as an essential substance by emulsion polymerization, and magnetic powder.

46. The image forming apparatus according to claim 45, wherein said magnetic polymerization toners are prepared by aging a part of at least said resin particles in said associated particles.

47. The image forming apparatus according to claim 45, wherein said magnetic polymerization toners have a volume average particle size d, a density ρ and a specific surface area S in such a relation that $6/\rho \cdot d \cdot S$ lies in a range of 0.3 to 0.8 and d is between 5 to 12 μm.

48. The image forming apparatus according to claim 44, further comprising distribution means, provided between said transfer means and said image forming means, for distributing residual toners on said latent image carrier.

49. An image forming apparatus for forming an image on a sheet, comprising:

a rotary endless latent image carrier;

image forming means for forming an electrostatic latent image on said latent image carrier;

developing means for forming a magnetic brush with a developer comprising magnetic toners and magnetic carriers in a developing room, for developing the electrostatic latent image on said latent image carrier with the magnetic brush, and for collecting residual toners on said latent image carrier with the magnetic brush, a toner density of the developer in the developing room being set lower than a limiting toner density; and transfer means for transferring said developed image on said latent image carrier to a sheet.

50. The image forming apparatus according to claim 49, further comprising partitioning means for partitioning said developing room and a toner supplying room to prevent moving the magnetic carriers from said developing room to said toner supplying room.

51. The image forming apparatus according to claim 49, further comprising distribution means, provided between said transfer means and image forming means, for distributing residual toners on said latent image carrier.

52. The image forming apparatus according to claim 51, wherein said magnetic toners are magnetic polymerization toners.

53. The image forming apparatus according to claim 52, further comprising partitioning means for partitioning said developing room and a toner supplying room to prevent moving the magnetic carriers from said developing room to said toner supplying room.

* * * * *